US011019891B2

(12) United States Patent
Ng

(10) Patent No.: US 11,019,891 B2
(45) Date of Patent: Jun. 1, 2021

(54) DEVICE FOR FORMING BRUNNIAN LINKS

(71) Applicant: Choon's Design LLC, Farmington Hills, MI (US)

(72) Inventor: Cheong Choon Ng, Novi, MI (US)

(73) Assignee: Choon's Design LLC, Farmington Hills, MI (US)

( * ) Notice: Subject to any disclaimer, the term of this patent is extended or adjusted under 35 U.S.C. 154(b) by 28 days.

(21) Appl. No.: 16/419,539

(22) Filed: May 22, 2019

(65) Prior Publication Data

US 2020/0367616 A1 Nov. 26, 2020

(51) Int. Cl.
*A44C 27/00* (2006.01)
*B65H 69/00* (2006.01)
*A44C 5/08* (2006.01)

(52) U.S. Cl.
CPC ..... *A44C 27/001* (2013.01); *A44C 5/08* (2013.01); *A44C 27/00* (2013.01); *B65H 69/00* (2013.01)

(58) Field of Classification Search
CPC ..... A44C 5/02; A44C 5/08; A44C 27/001; D44C 27/001; B65H 69/00; D04B 3/00; D04B 5/00; D04D 11/00
See application file for complete search history.

(56) References Cited

U.S. PATENT DOCUMENTS 222,937 A * 12/1879 Newcomb ..... D04B 39/00 66/4
289,578 A * 12/1883 Stewart ..... D04B 39/00 66/4
2,658,364 A * 11/1953 Carlson ..... D04B 9/44 66/4
5,231,742 A * 8/1993 Macbain ..... D03D 29/00 139/34
D563,997 S * 3/2008 Gustin ..... D15/78
D707,732 S * 6/2014 Crorey ..... D15/66
8,746,753 B2 * 6/2014 Crorey ..... D04G 5/00 289/13
8,931,811 B1 * 1/2015 Ng ..... D04B 5/00 289/17
D737,340 S * 8/2015 Shirai ..... D15/66
D748,159 S * 1/2016 Ng ..... D15/66
D773,174 S * 12/2016 Okuma ..... D3/26
9,903,055 B2 * 2/2018 Todokoro ..... D04B 3/00
2008/0223083 A1 * 9/2008 Gustin ..... D04B 5/00 66/1 A
2012/0112457 A1 * 5/2012 Ng ..... B65H 69/04 289/1.5
2014/0239635 A1 * 8/2014 Ng ..... B65H 69/04 289/17
2015/0042091 A1 * 2/2015 Tommer ..... A44C 5/02 289/1.5
2015/0296937 A1 * 10/2015 Ng ..... D04D 7/04 289/17

* cited by examiner

*Primary Examiner* — Shaun R Hurley

(74) *Attorney, Agent, or Firm* — Carlson, Gaskey & Olds, P.C.

(57) ABSTRACT

A Brunnian link is a link formed from a closed loop doubled over itself to capture another closed loop to form a chain. Elastic bands can be utilized to form such links in a desired manner. The example device provides a means of holding elastic bands in place to enable the creation of an item formed of Brunnian links.

7 Claims, 22 Drawing Sheets

DEVICE FOR FORMING BRUNNIAN LINKS

BACKGROUND

This disclosure generally relates to method and device for creating a linked item. More particularly, this disclosure relates to a method and device for creating a linked wearable item from elastic bands.

Kits that include materials for making a uniquely colored bracelet or necklace have always enjoyed some popularity. However, such kits usually just include the raw materials such as different colored threads and beads and rely on the individual's skill and talent to construct a usable and desirable item. Accordingly there is a need and desire for a kit that provides not only the materials for creating a unique wearable item, but also that eases construction to make it easy for people of many skill and artistic levels to successfully create a desirable and durable wearable item.

SUMMARY

A Brunnian link is a link formed from a closed loop doubled over itself to capture another closed loop to form a chain. Elastic bands can be utilized to form such links. The example device provides a means of holding elastic bands in place to create an item formed of Brunnian links.

Although the different examples have the specific components shown in the illustrations, embodiments of this invention are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
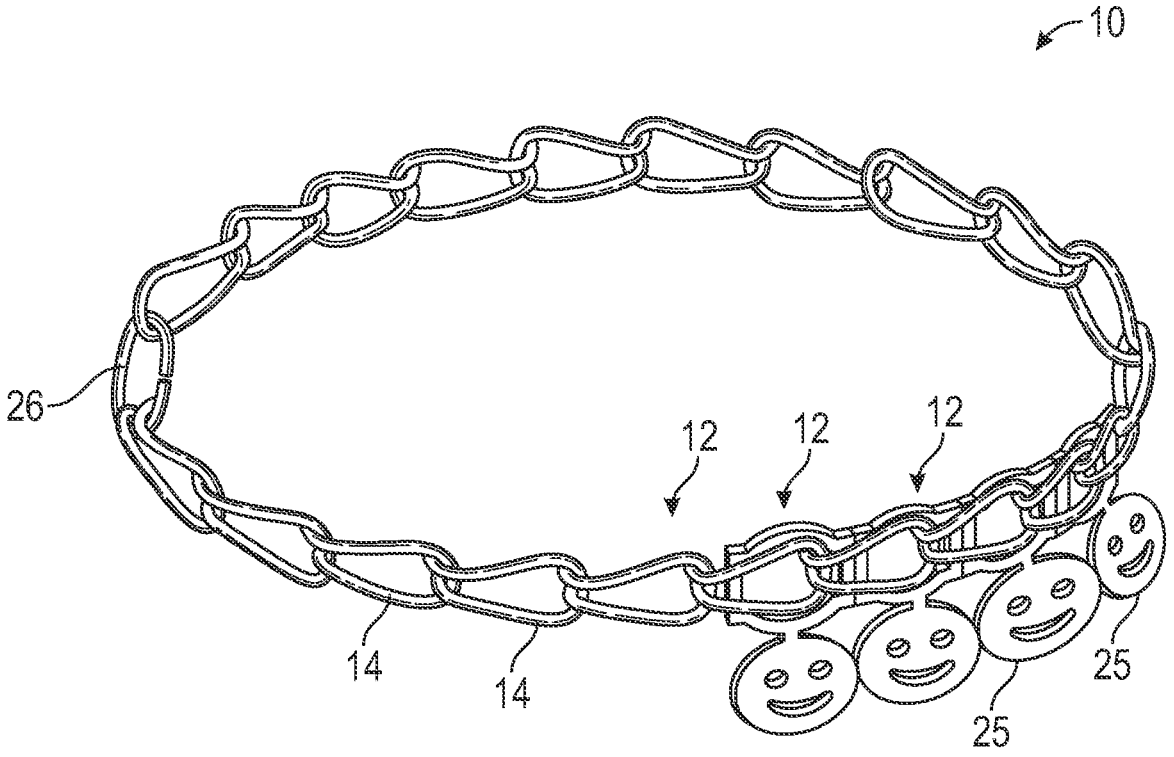
FIG. 1 is a schematic view of an example linked article.
Figure 2:
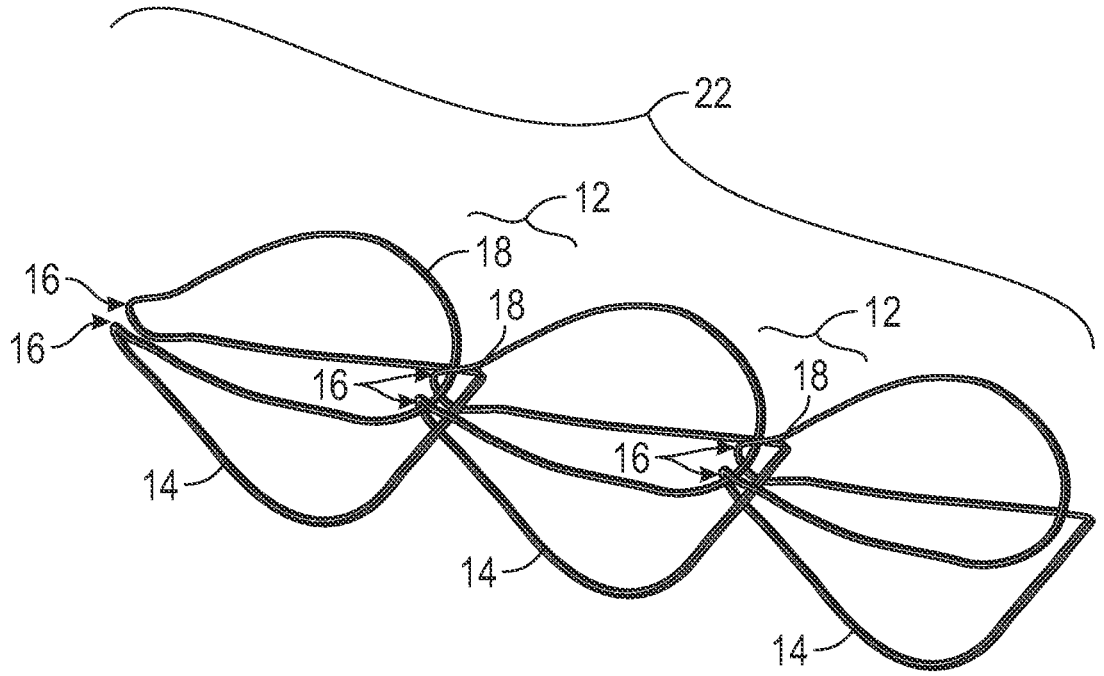
FIG. 2 is a schematic view of an example Brunnian link formed from elastic bands.

Referring to FIGS. 1 and 2, a Brunnian link is formed from a continuous looped structure such as an elastic band 14 without forming an actual knot. Several elastic bands 14 are linked together with a Brunnian link 12 to form a chain 22. The chain 22 can be fashioned to form a linked article such as a bracelet 10. The ends of the series of elastic bands links are then secured with a clip 26 to complete a durable wearable item 10. In this example, three closed looped elastic bands 14 are shown forming a single chain 22. Capturing ends 16 of one elastic band 14 with a mid-portion 18 of another elastic band 14 forms each link 12. Each link 12 depends on the previous and subsequent links 12 to maintain the desired linked article as shown. Although a bracelet 10 is shown by way of example, other articles can be formed utilizing different Brunnian link structures and are within the scope and contemplation of this disclosure.

The example bracelet 10 includes charms 25 that are assembled into the links 12 to provide an additional aesthetic variation to the completed bracelet. In this example, four charms 25 are secured within in links 12 between a single row of elastic bands 14, however, other numbers, spacing and orientations of the example charms 25 are possible and within the scope and contemplation of this disclosure.

Figure 3:
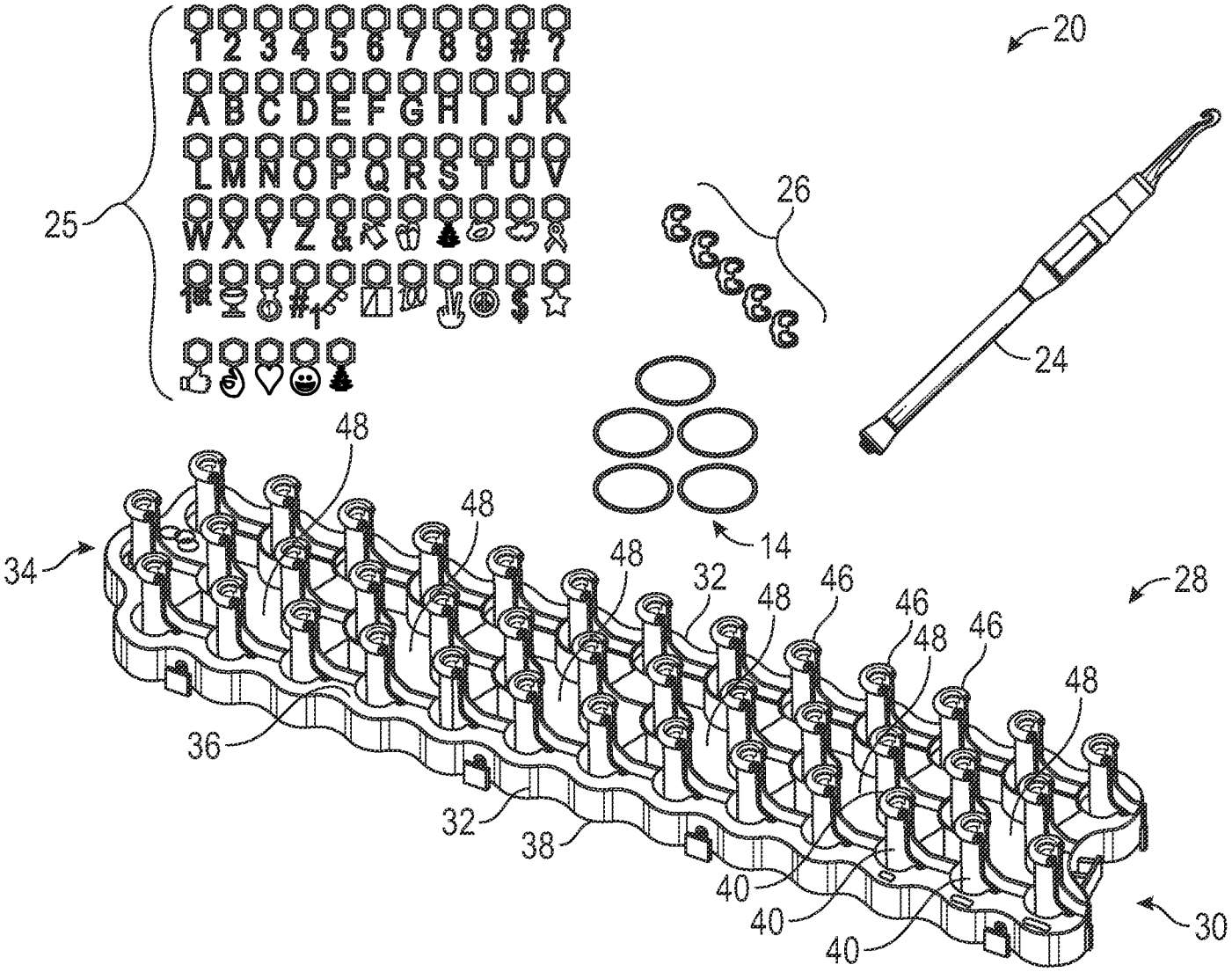
FIG. 3 is a schematic view of an example embodiment of a kit for forming a Brunnian linked article.

Referring to FIG. 3, schematically shown is an example kit 20 for making a Brunnian linked that includes, among other possible things, a loom 28, a hook tool 24 and a series of clips 26. The kit further includes elastic bands 14 and charms 25. The elastic bands 14 are mounted to pins 40 of the loom 28 in different orientations to enable formation of Brunnian links. The elastic bands 14 may be placed on the pins 40 in many different orientations and numbers to enable formation of different combinations of Brunnian links. The example charms 25 are shown by way of example and may be of any shape, color and size within the scope and contemplation of this disclosure. The clips 26 secure ends of the completed Brunnian linked item to prevent unraveling.

The example loom 28 includes a first end 30 spaced apart longitudinally from a second end 34. The pins 40 are arranged in rows between the first end 30 and the second end 34. In this disclosed example, the pins 40 are arranged in three rows between sides 32. The pins 40 extend upward relative to a top surface 36. At least one opening 48 is provided completely through the top surface 36 such that it is open to a bottom surface 38. The openings 48 enable a linked item to extend downward through the top surface 36 during formation of a linked item according to one example embodiment of this disclosure.

In this disclosed example, the loom 28 is a single integral part. However, the loom 28 may be formed in different parts that are assembled together. Moreover, although three rows of pins 40 are shown by way of example, other numbers of rows are within the contemplation and scope of this disclosure.

Figure 4:
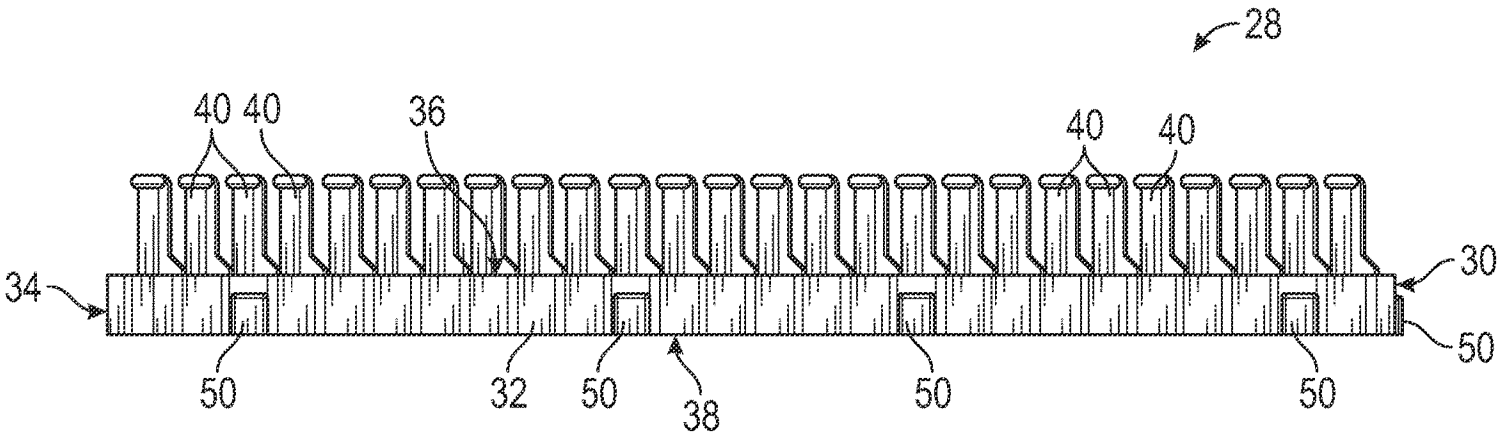
FIG. 4 is a side view of an example loom embodiment.
Figure 5:
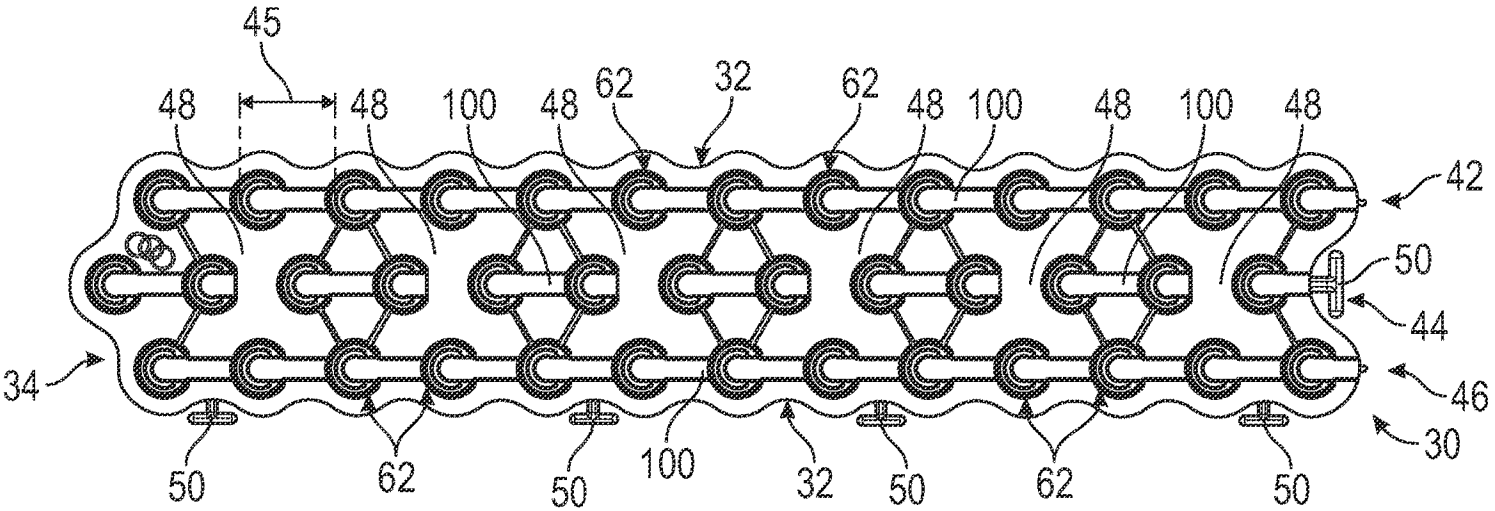
FIG. 5 is a top view of the example loom embodiment.

Referring to FIGS. 4 and 5, the example loom 28 includes the plurality of pins 40 that are arranged in rows that extend from the first end 30 toward the second end 34. In this example, there are three rows including a middle row 44, a first side row 42 and a second side row 46. The middle row 44 is offset relative to the first side row 42 and the second side row 46. The offset of the middle row 44 is about half a distance 45 between pins 40 in a common row. It should be appreciated, that although the middle row 44 is offset relative to the side rows 42, 46, the middle row 44 may be aligned or otherwise orientated relative to the side rows 42, 46 and remain within the contemplation and scope of this disclosure.

The example openings 48 are disposed between at least four of the pins 40. The at least four pins 40 include one pin 40 from each of the first side row 42 and the second side row 46 and two pins 40 in the middle row 44. The example opening 48 further extends along the side of three pins 40 within each of the first side row 42 and the second side row 46 such that the opening is disposed between eight of the pins 40. The opening 48 extends up to a location near each pin 40.

Figure 6:
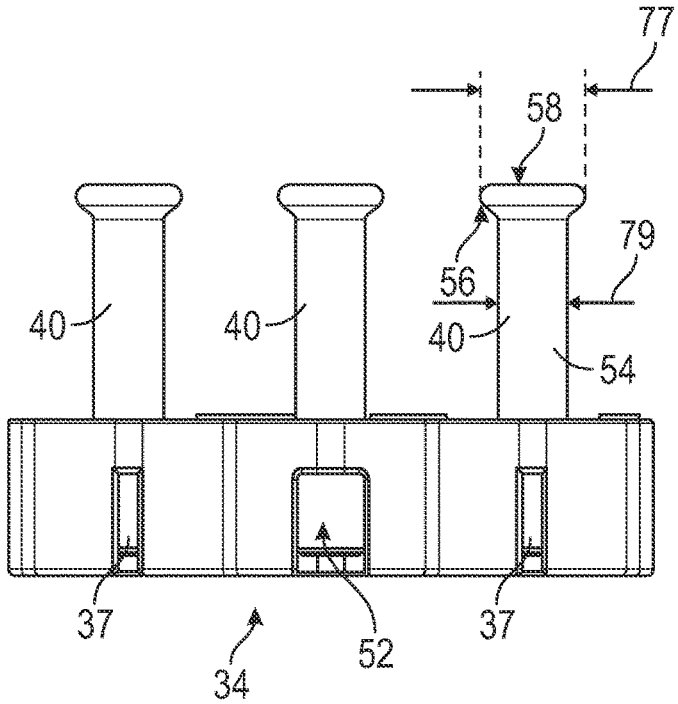
FIG. 6 is an end view of the example loom embodiment.
Figure 7:
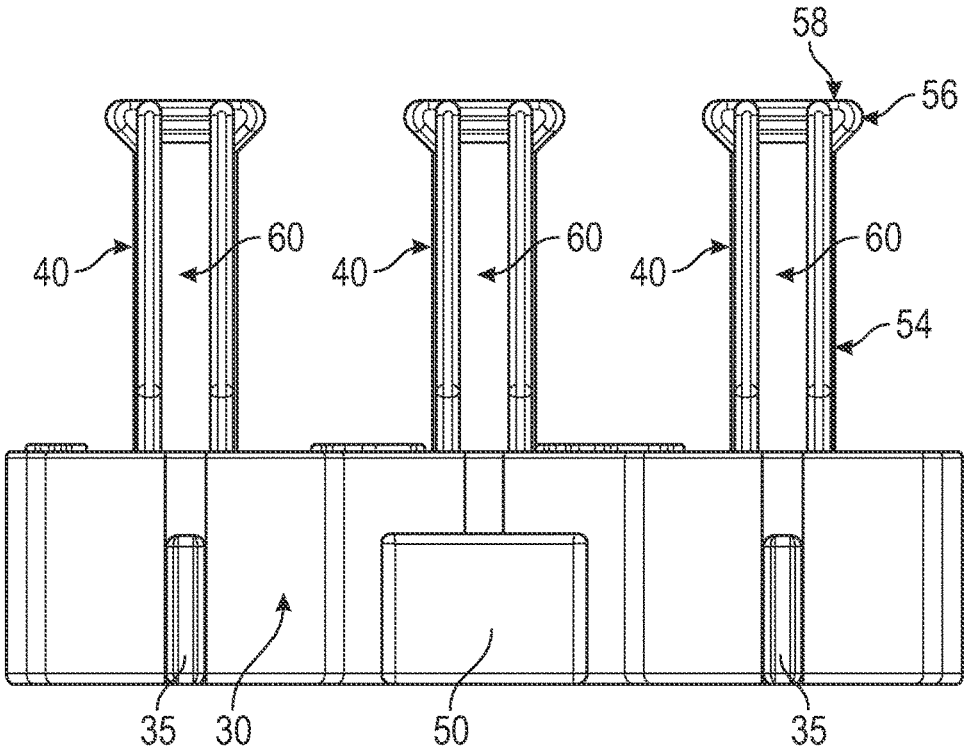
FIG. 7 is another end view of the example loom embodiment.
Figure 8:
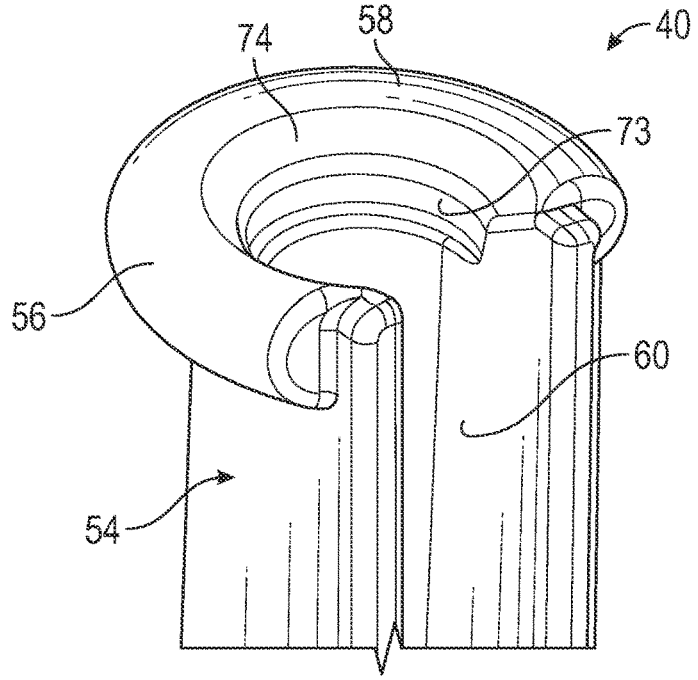
FIG. 8 is a perspective view of a portion of an example pin.

Referring to FIGS. 6, 7 and 8, with continued reference to FIGS. 4 and 5, each of the pins 40 include a forward-facing slot 60. The forward-facing direction is the direction toward the first end 30. Moreover, each of the pins 40 has the slot 60 facing in a common direction. In this disclosed example, the common direction is toward the first end 30.

Each of the pins 40 include a flange 56 that defines a top surface 58. The slot 60 extends through the vertical length of the pin 40 and extends through the flange 56 and the top surface 58. The flange 56 includes a tapered portion 74 that defines a transition from the top surface 58 to the slot 60. The tapered portion 74 transitions the top surface 58 into an inner surface 73 of the slot 60. The example pin 40 includes a shaft 54 that defines an outer surface onto which the elastic bands 14 are held when forming a Brunnian link. The shaft 54 includes a width 79. The width 79 is the largest width of the shaft 54 measured on surfaces not including the slot 60. The flange 58 holds the bands 14 in place as the bands are grasped, pulled and manipulated from one pin 40 to another during the formation of a Brunnian link. The example flange 58 extends about approximately ¾ of the pin 40 such that one band 14 is supported on at least some portion of the flange 58 when another band is pulled up and through. The pin 40 is generally cylindrical with the slot 60 interrupting the cylindrical shape facing the first end 30. The flange 58 is also interrupted by the slot 60.

The top surface 36 includes channels 100 adjacent each of the pins 40 that is not bounded on a forward-facing side by the opening 48. Only a few of the channels 100 are indicated for clarity. The channels 100 are open to the slot 60 within each of the pins 40. The channels 100 extend in a longitudinal direction toward the first end 30 from each of the pins 40. The channels 100 enable a tool, such as the example hook 24, to extend into the slot 60 below the top surface 36. The slot 60 extends from the pin 40 below the top surface 36 to match a bottom surface of the channel 100.

In this disclosed example embodiment, one of the pins 40 that surrounds the opening 48 includes the slot 60 that is open to the opening 48. In this example, the pin 40 is within the middle row 44 includes the slot 60 that is open to the opening 48.

The example opening 48 is irregularly shaped and bounded at each corner by a pin 40. The shape of the opening 48 provides for an open space through the top surface 36 between at least two adjacent pins 40 to enable formed links to extend downward. Because links may extend downward through the opening 48, a chain of link of any length may be formed independent of a longitudinal length of the loom 28.

Each of the pins 40 is surrounded by a groove 62 around the cylindrical shaft 54. The groove 62 extends through the top surface 36 an enables formation of the shaft 54 with a portion of the mold that extends upward past the bottom surface 38.

The loom 28 can be attached to other looms in an end to end or side by side orientation. The example loom 28 includes tabs 50 and slots 52 on opposite sides and/or ends. The tap 50 is configured to fit within slots 52. Additionally, the sides 32 each include a wavy configuration that aligns looms 28 and thereby the pins 40 on different looms with each other. In this disclosed example, the first end 30 includes a tab 50 and the second end 34 includes a slot 52. In this example, one side 32 includes tabs 50 and the opposite side 32 includes slots 52. The first end 30 also includes an alignment tab 35 that is received within a corresponding slot 37 disposed on the second end 34.

Figure 9:
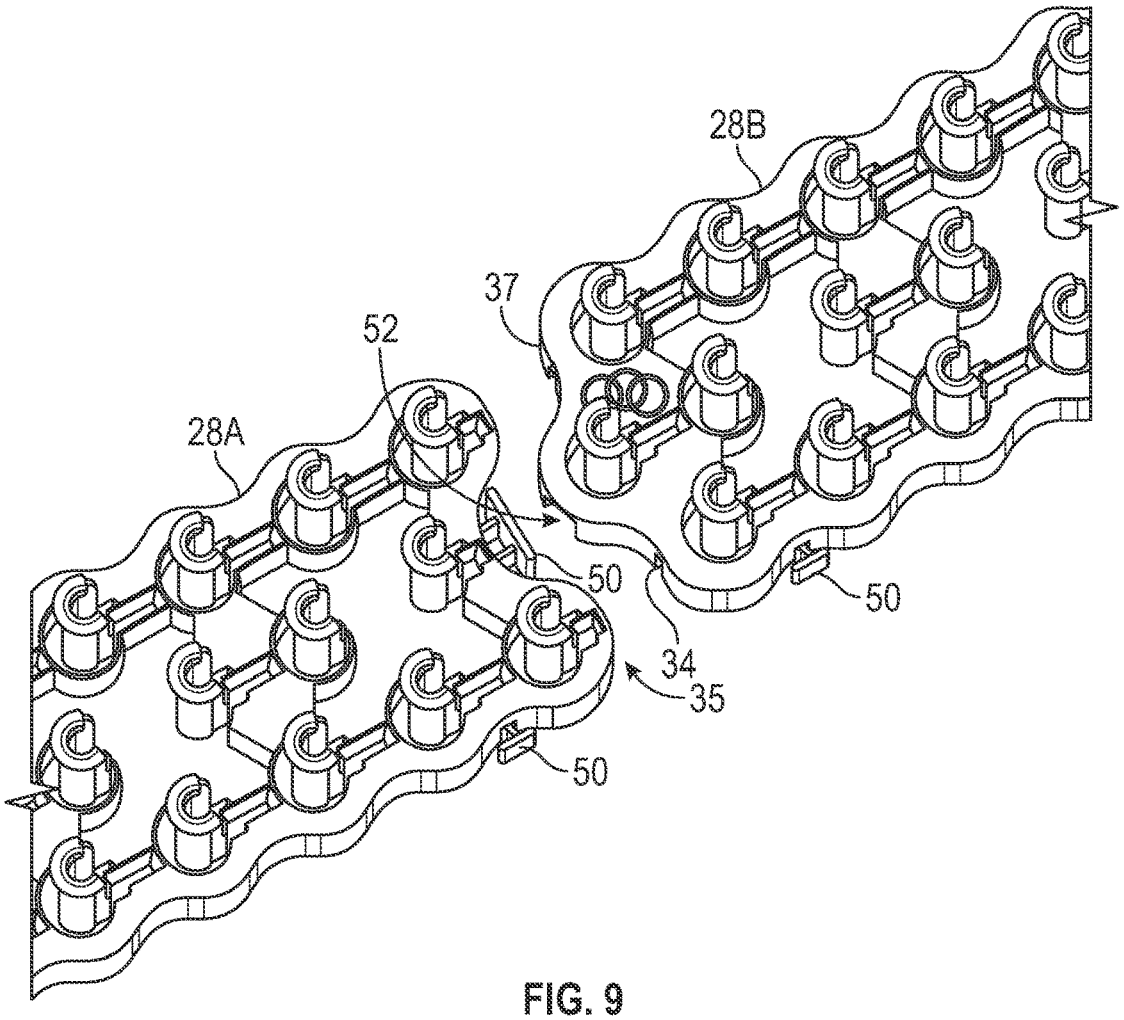
FIG. 9 is a perspective view of two example looms being joined end to end.
Figure 10:
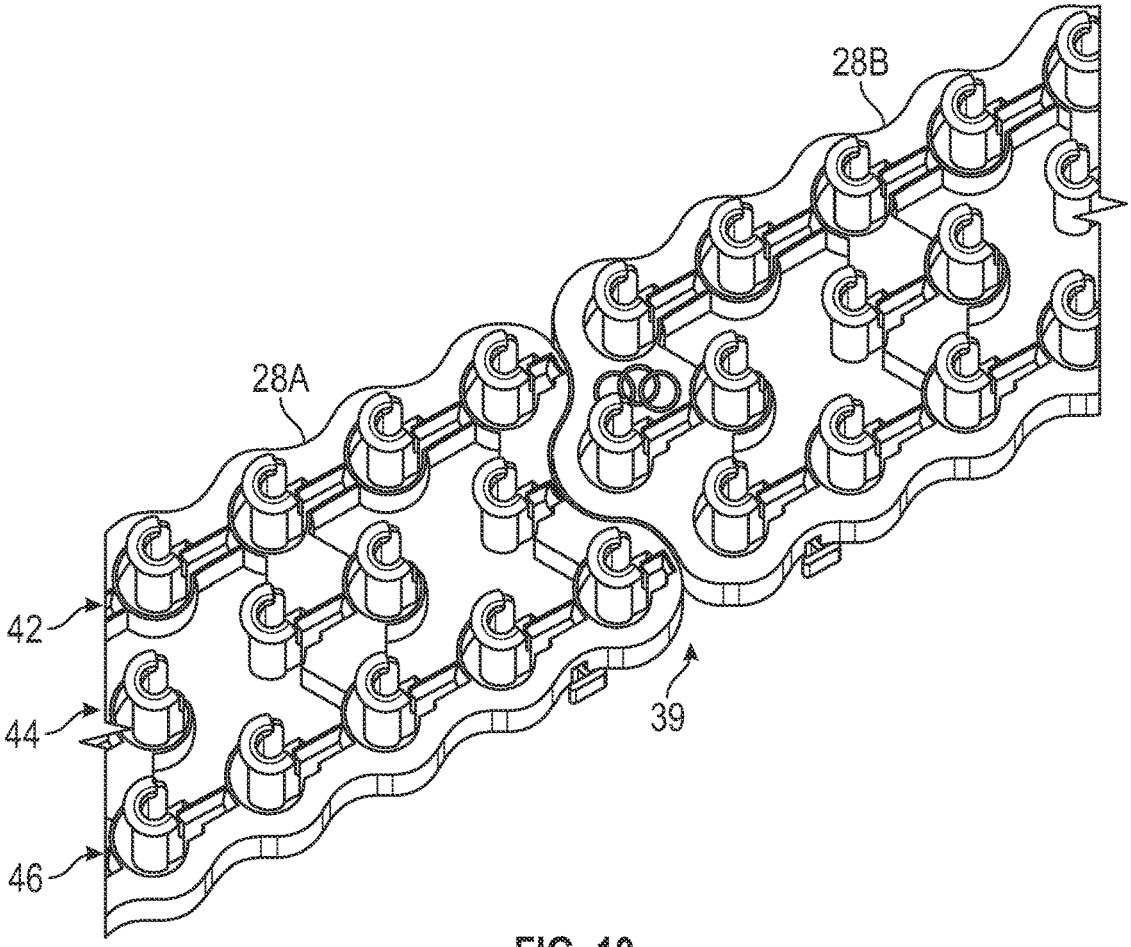
FIG. 10 is a perspective view of two example looms joined end to end.
Figure 11:
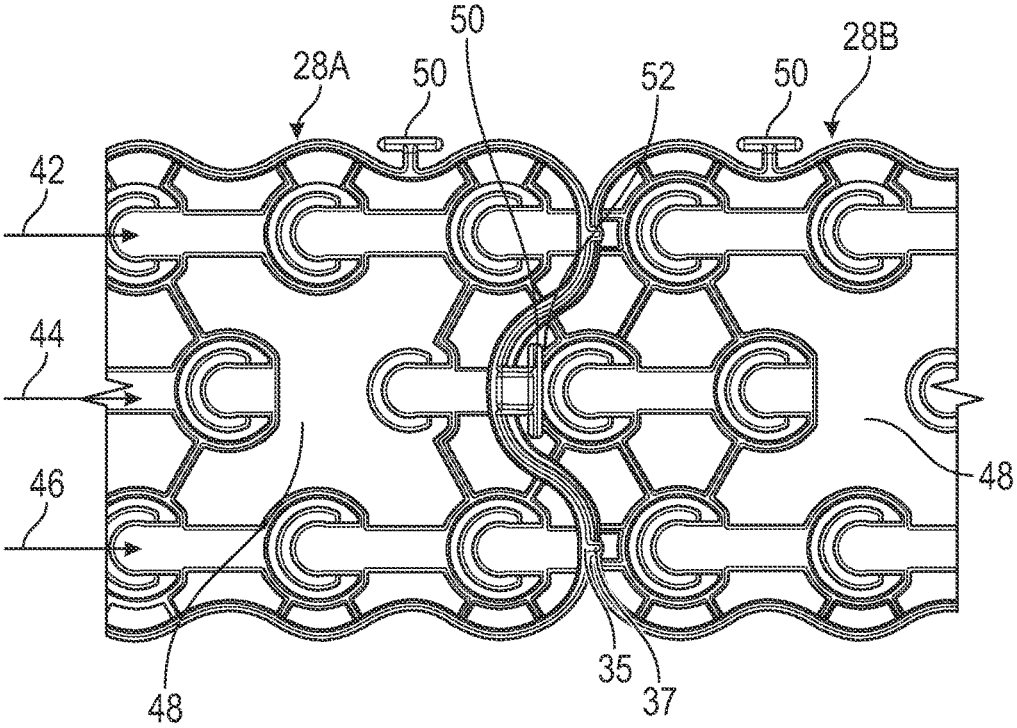
FIG. 11 is a top view of two example looms joined end to end.

Referring to FIGS. 9, 10 and 11 with continued reference to FIGS. 4-8, a first loom 28A is attachable to a second loom 28B in an end to end manner to extend the rows 42, 44 and 46. A first end 30 of the first loom 28A is attached to a second end 34 of the second loom 28B. The first end 30 includes the tab 50 and the end tabs 35. In this disclosed example, the tab 50 is substantially T-shaped (Best shown in FIG. 5) and fits within a correspondingly shaped slot 52. The fit between the tabs 50 and the slot 52 holds the first and second looms 28A and 28B together. The end tab 35 on the first end 30 of the first loom 28A fit into the slot 37 on the second end 34 of the second loom 28B. The fit between the end tab 35 and the slot 37 provides for alignment and prevents movement in a side to side manner. The shape of the first end 30 and the shape of the second end 34 are also shaped in a manner to provide alignment and prevent side to side movement.

An interface 39 defined between the ends 30 and 34 uses the fit between the tab 50 and the slot 52 to maintain the relative orientation between looms 28A, 28B. The rows 42, 44 and 46 of pins 40 continue from the first loom 28A to the second loom 28B. The spacing at the interface 39 between pins 40 in the first loom 28A and pins 40 in the second loom 28B is substantially the same as pins within a common one of the first loom 28A and the second loom 28B. It should be appreciated that although two looms 28A, 28B are shown connected, that any number of looms may be attached together to increase the number of pins in each row 42, 44 and 46.

Figure 12:
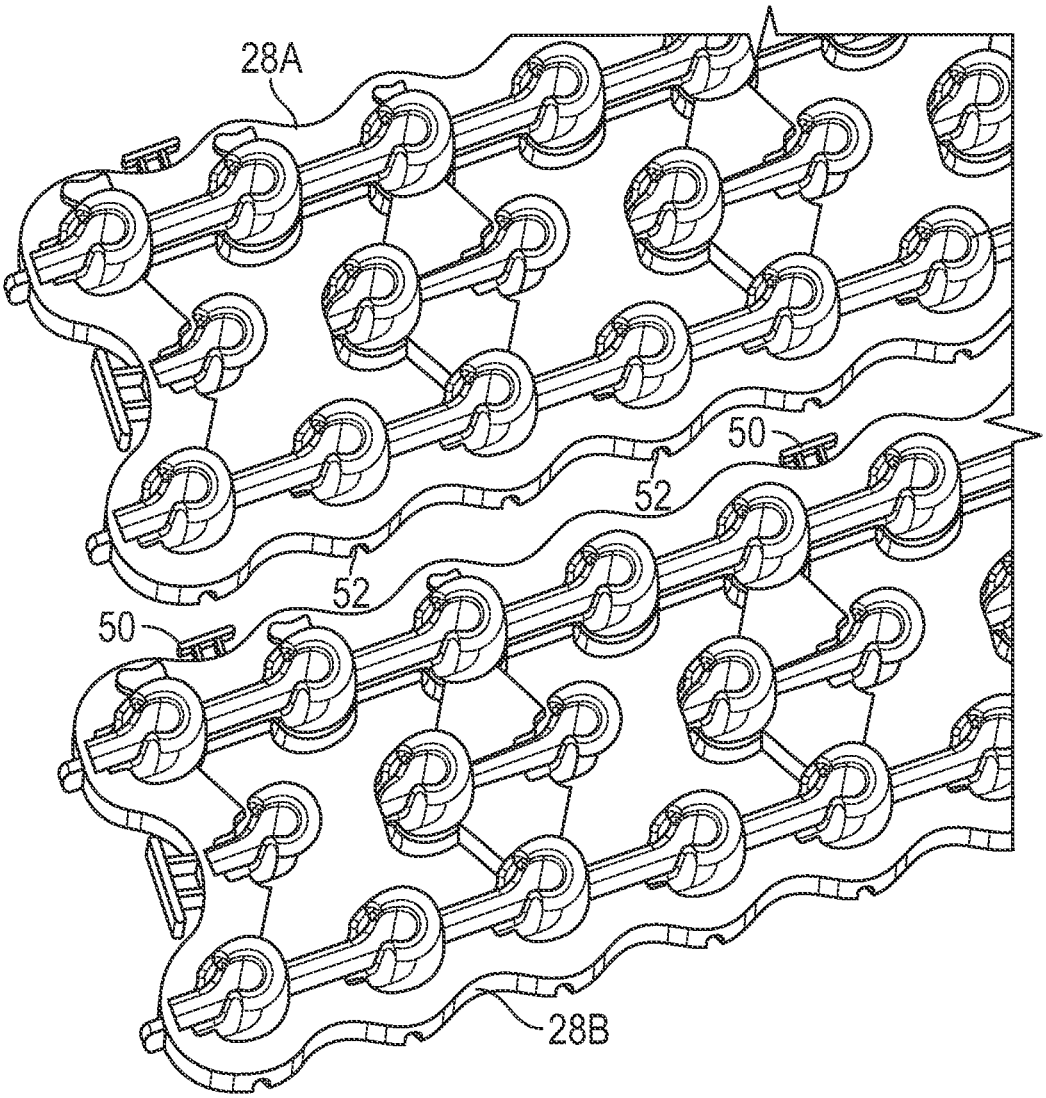
FIG. 12 is a perspective view two example looms being joined side by side.
Figure 13:
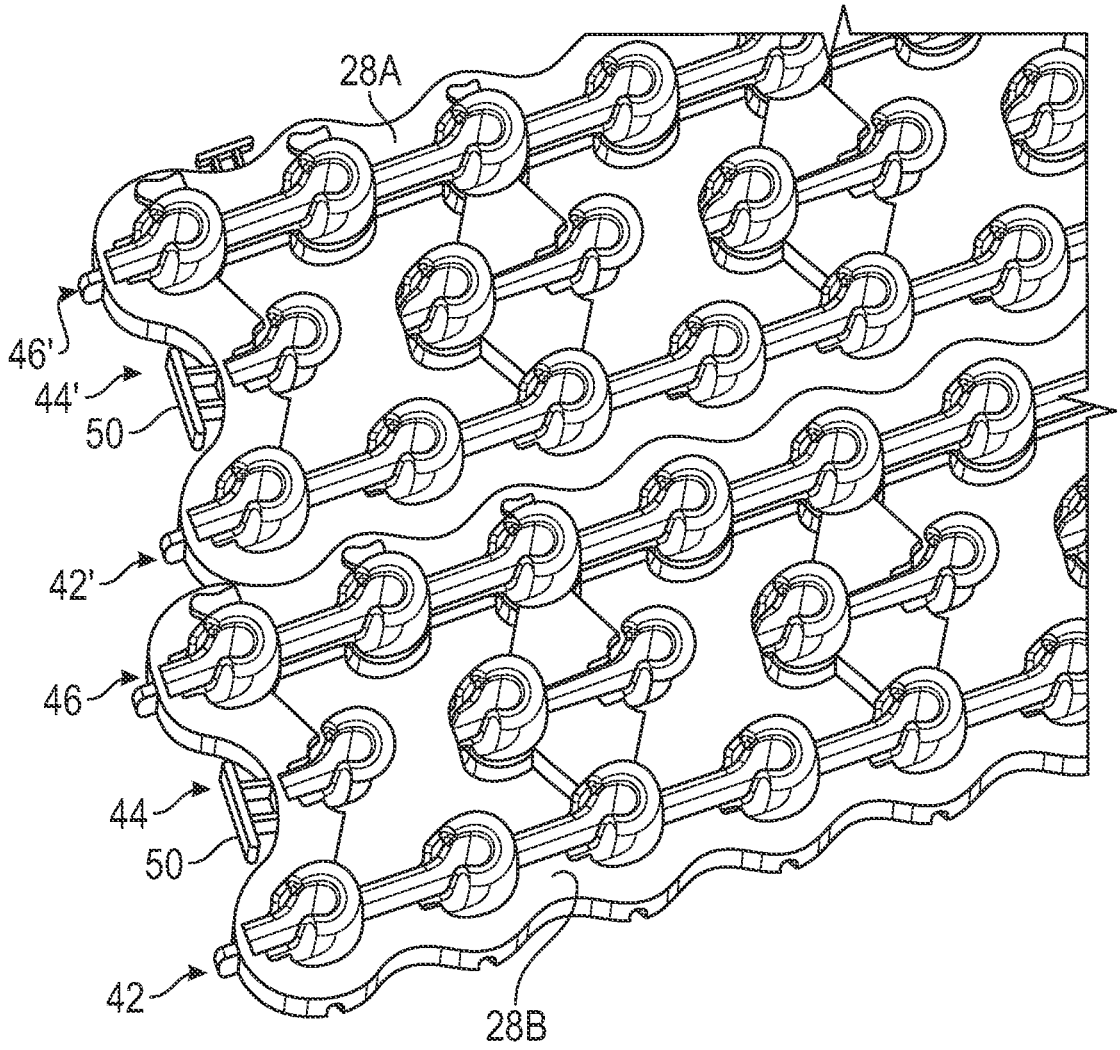
FIG. 13 is a perspective view of two example looms joined side by side.
Figure 14:
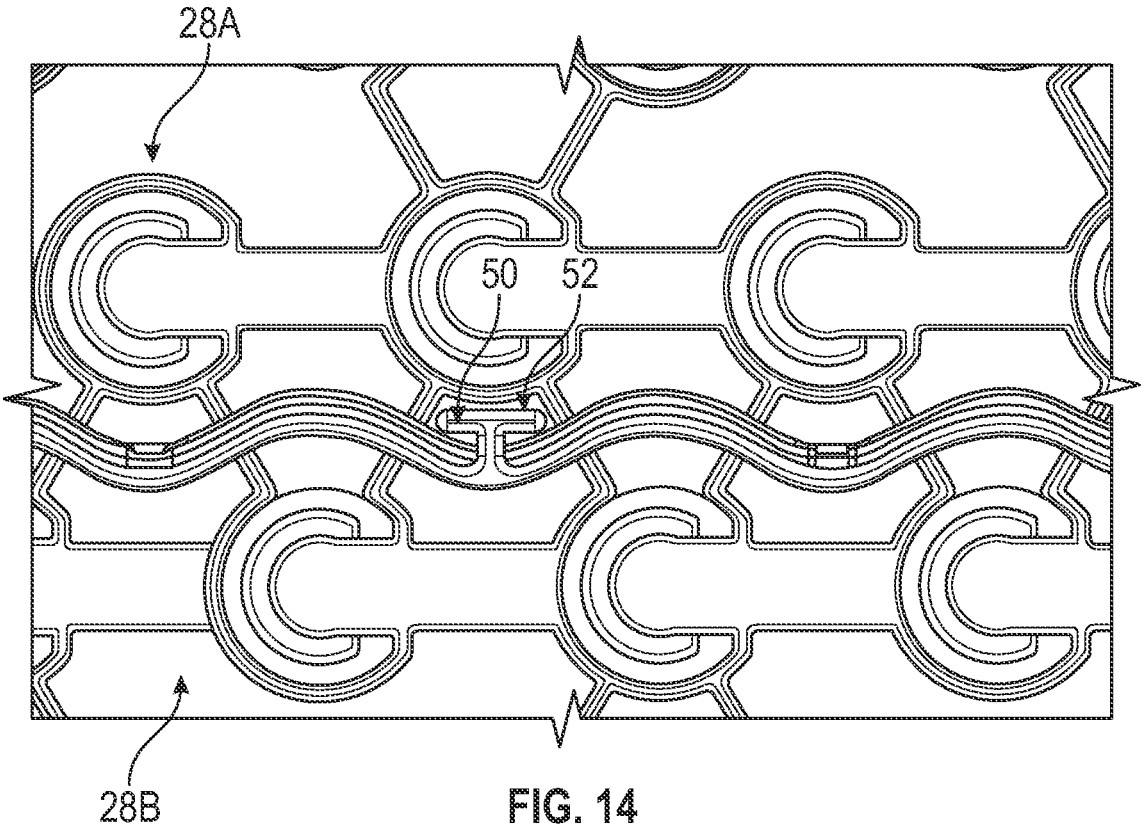
FIG. 14 is a top view of a portion of the two example looms joined side by side.

Referring to FIGS. 12, 13 and 14 with continued reference to FIGS. 4-8, the first loom 28A is attachable to the second loom 28B in a side-by-side manner as is shown in FIG. 12. One side 32 of the first loom 28A includes slots 52 that receive tabs 50 on the second loom 28B. The looms 28A and 28B are secured by the tabs 50 and slots 52 to expand the number of rows across. In this example, two looms 28A and 28B are attached in a side-by-side orientation to double the number of rows from three to six. In this example, the first loom 28A includes side row 42', middle row 44' and side row 46' and is offset relative to the second loom 28B. The offset orientation sets one pin 40 within a side row 46 of the second loom 28B relative to a pin 40 in a side row 42' of the first loom 28A.

It should be appreciated that additional looms 28 can be added either end-to-end as is shown in FIGS. 9-11, side-by-side as shown in FIGS. 12-14 and/or any combination of end-to-end or side-by-side with any number of looms 28.

Figure 15:
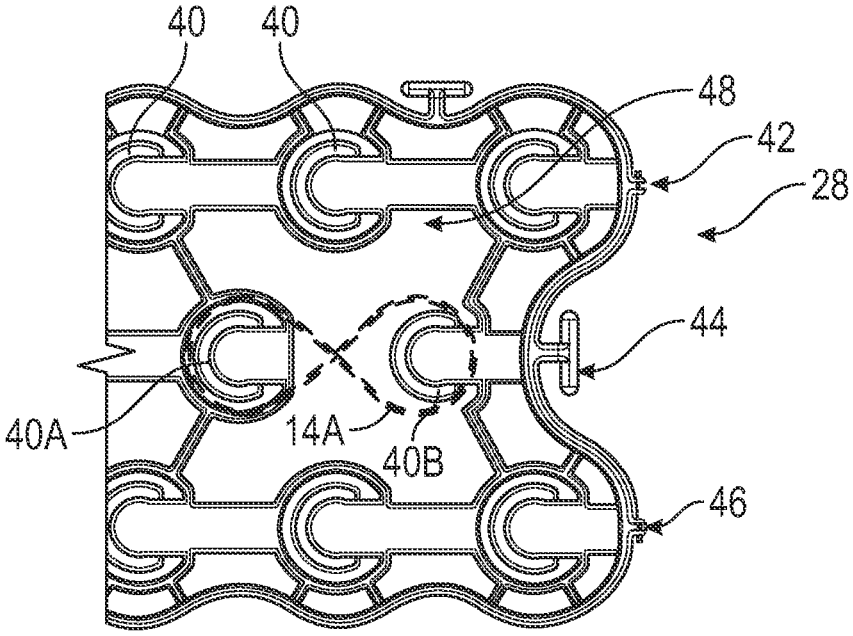
FIG. 15 is a top view of an opening in the example loom.

Referring to FIG. 15, with continued reference to FIGS. 4-8, the example loom 28 includes the opening 48 that enables linked articles to be feed down through the top surface 36. Feeding linked elastic bands through the opening 48 enables formation of linked articles of different lengths independent of the number of pins 40. In one disclosed method of forming a linked article, a first elastic band 14A is stretched across a first pin 40A and a second pin 40B. The first pin 40A and the second pin 40B are an opposing sides of the opening 48 and are both within the middle row 44. The elastic band 14A may also be stretched across pins 40 in a direction transverse to the length of the loom 28. A pin 40 within the first side row 42 and the second side row 46 disposed across the opening would be utilized. In this example, the pins 40A and 40B are utilized and a first elastic band 14A is twisted into an X-shape between the pins. The X-shape assembly is used only for the first elastic band 14A. Once the first elastic band 14A is assembled, additional elastic bands are assembled across the same two pins 40A-B.

Figure 16A:
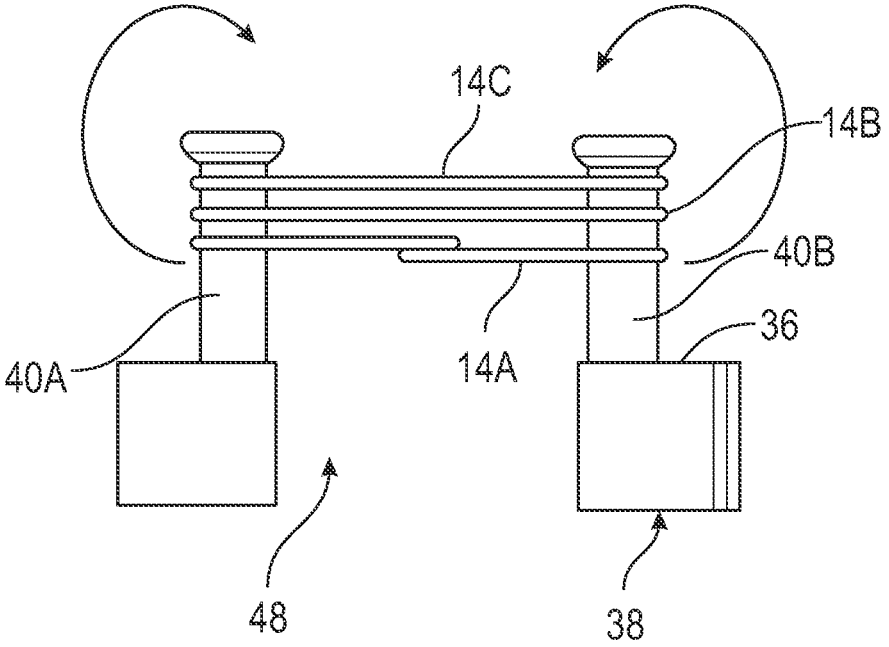
FIG. 16A is a schematic view of one step in an example method of creating a linked article.

Referring to FIGS. 16A-E, the example method continues with the addition of two additional elastic bands 14B and 14C. The two elastic bands 14A and 14B are placed atop the first elastic band 14A as is shown in FIG. 16A.

Figure 16B:
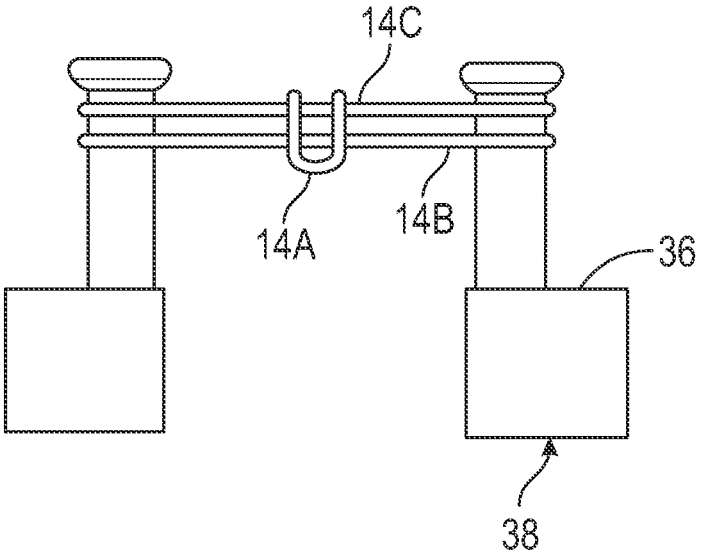
FIG. 16B is a schematic view of another step of the example method of creating a linked article.
Figure 16C:
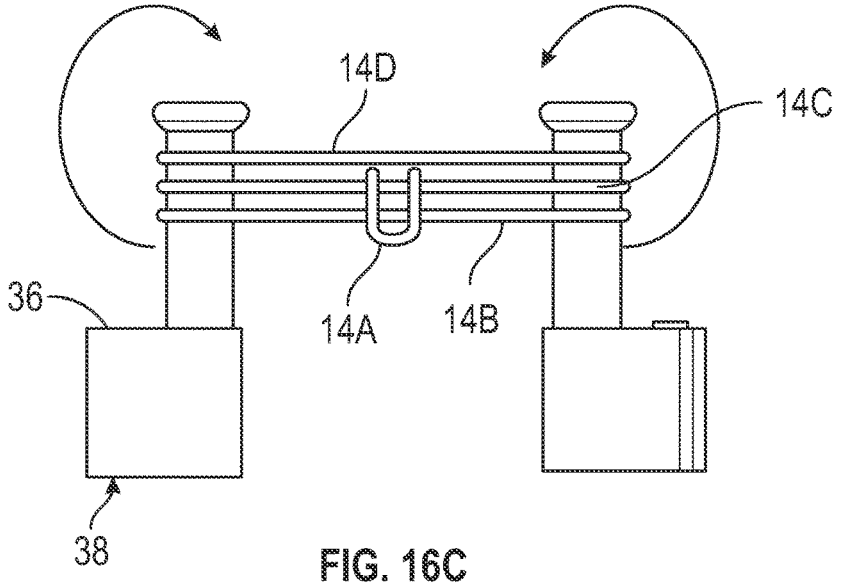
FIG. 16C is a schematic view of another step of the example method of creating a linked article.

The first elastic band 14A is then lifted off of the pins 40A, 40B and left to rest on the elastic bands 14B and 14C as is shown in FIG. 16B. In the position shown in FIG. 16B, the first elastic band 14A is wrapped around both the second elastic band 14B and 14C. An additional elastic band 14D is placed over the second and third elastic bands 14B-C as is shown in FIG. 16C. The lowermost band is then lifted from the pins and onto the other elastic bands and is schematically indicated in FIG. 16C.

Figure 16D:
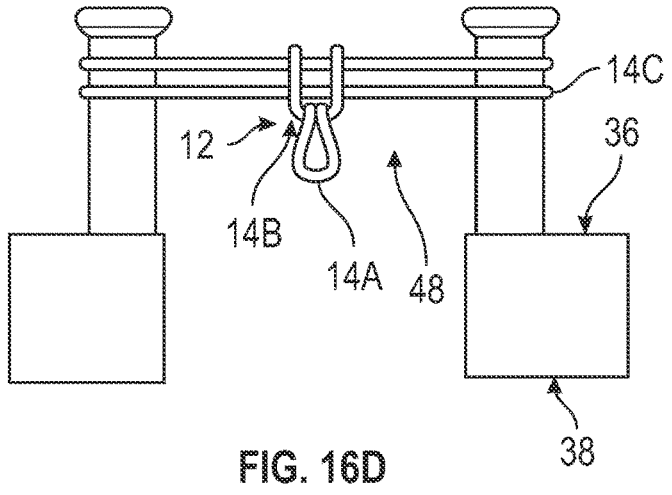
FIG. 16D is a schematic view of another step of the example method of creating a linked article.
Figure 16E:
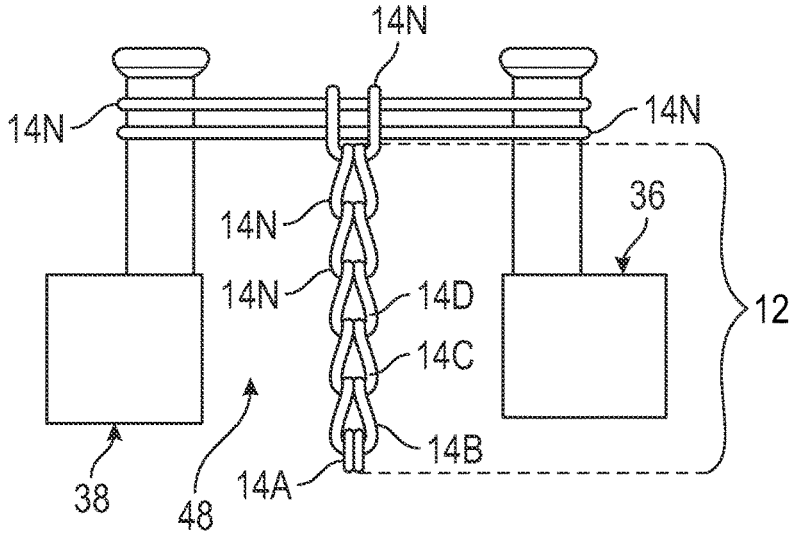
FIG. 16E is a schematic view of another step of the example method of creating a linked article.

The second elastic band 14B extends through the first elastic band 14A and about the other elastic bands 14C and 14D as shown in FIG. 16D. The process of adding an elastic band atop those on the pins 40A-B and pulling the lowermost band over top is repeated as many times as necessary to create a sufficient number of links to provide the desired length of the linked article. In this example, the additional elastic bands are indicated as 14N in FIG. 16E for forming the any links 12 needed to form the desired linked article. The number of elastic bands 14 can be varied to provide the desired length. Additionally, more than one elastic band can be added at each step to provide a different density and look of the completed article.

The completed links 12 extend downward through the opening 48 and therefore enable the links to be neatly formed throughout assembly. Additionally, the opening 48 provides additional access to the elastic bands during assembly.

Figure 17:
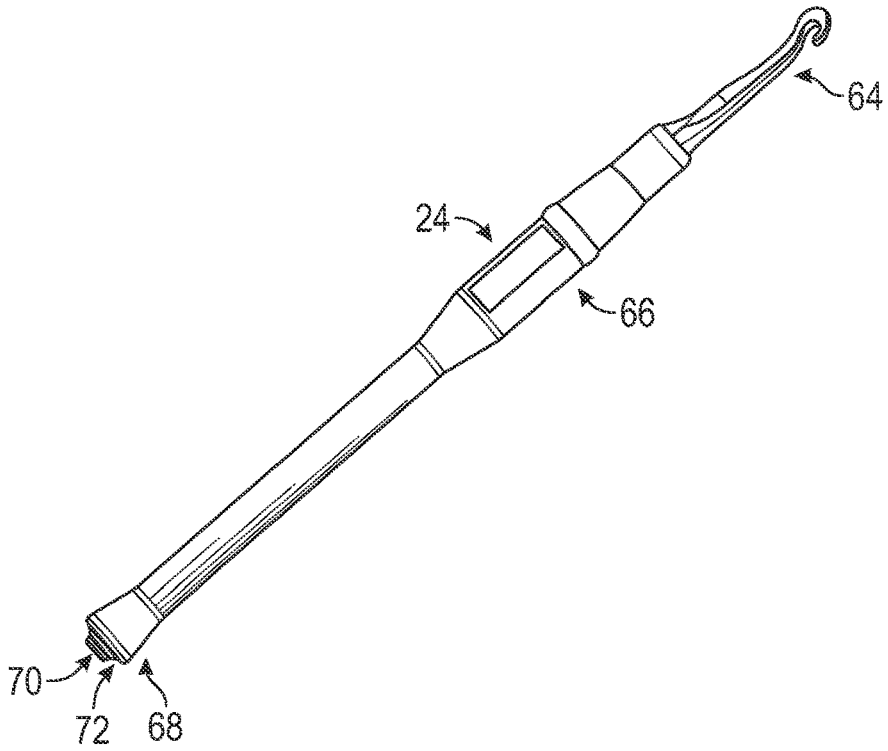
FIG. 17 is a perspective view of an example hook tool embodiment.

Referring to FIG. 17, an example hook tool 24 includes a hook 64 that extends from a first end of a barrel 66. An end portion 68 is disposed on an opposite end of the barrel 66 relative to the hook 64. The disclosed example hook tool 24 is integral part formed from common plastic material. Moreover, the example hook tool 24 may also include a metal hook 64 molded to or otherwise attached to the barrel 66.

The end 68 includes an alignment pin 70 that extends outward relative to a taper 72. The taper 72 provides a transition radially away from the pin 70 toward an outer diameter of the barrel 66.

Figure 18:
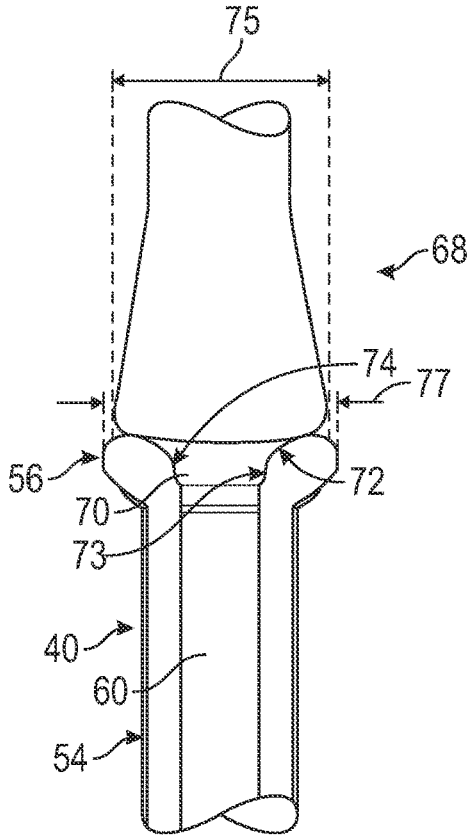
FIG. 18 is a cross-section view of a portion of the example hook tool engaged with a top surface of a pin of the example loom.

Referring to FIG. 18, the end 68 fits against the top surface 58 of the pins 40. The pin 70 fits within the slot 60 and the taper 72 fits into the taper 74 of the pin 40. The taper 72 and taper 74 are shaped in a manner to enable an outer diameter 75 to align with the width 77 of the flange 56 (Shown in FIG. 6). Alignment of the outer surface of the flange 56 and the end 68 is used to assembly elastic articles such as elastic bands and charms to a pin individually instead of across adjacent ones of the pins 40.

Figure 19A:
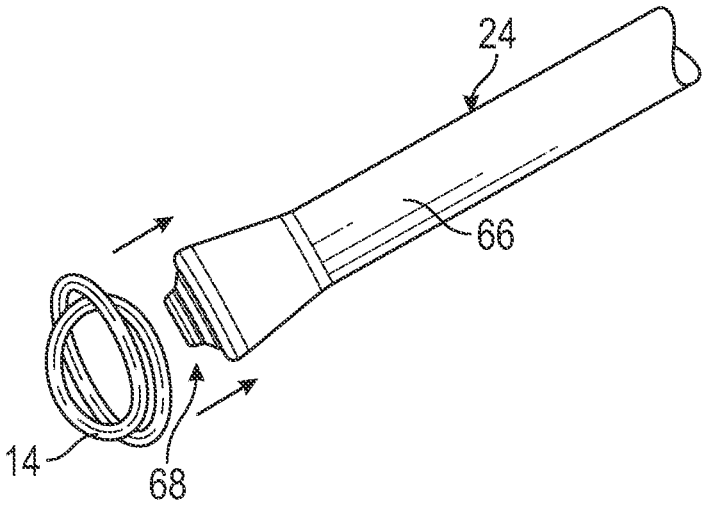
FIG. 19A is a schematic illustration of a step in assembling an example charm within a linked article.
Figure 20A:
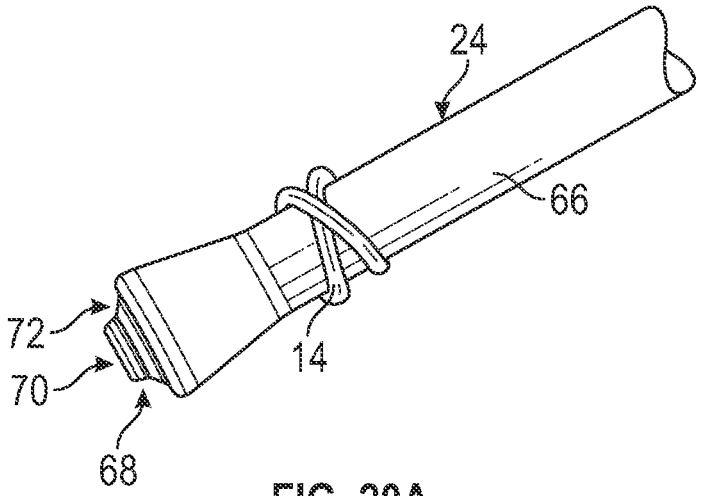
FIG. 20A is a side view of an example elastic band mounted to an end of the example hook tool.

Referring to FIGS. 19A and 20A with continued reference to FIG. 18, an elastic band 14 can be assembled within a Brunnian link to provide a different aesthetic design. The elastic band 14 is doubled over itself and placed over the end 68 of the hook tool 24 onto the barrel 66. One or a plurality of bands 14 can be placed on the barrel 66 in preparation for assembly into the Brunnian linked item.

Figure 19B:
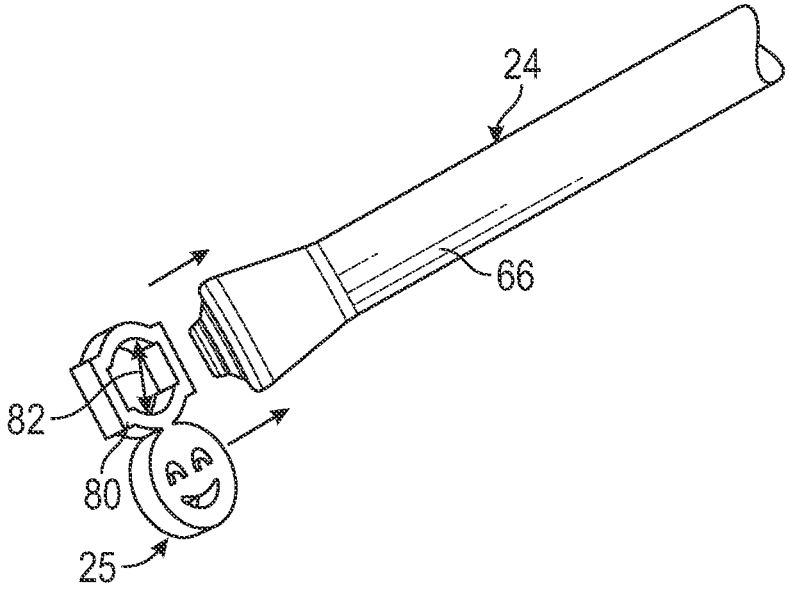
FIG. 19B is a schematic illustration of a step of assembling an elastic band within a linked article.
Figure 20B:
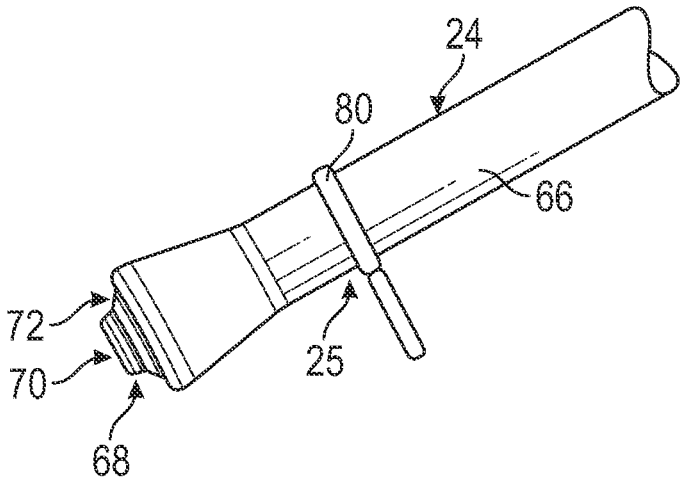
FIG. 20B is a side view of the example charm mounted to an end of the example hook tool.

Referring to FIGS. 19B and 20B with continued reference to FIG. 18, a charm 25 includes a mount portion 80 that is mountable onto the end 68 of the hook tool 24. The mount portion 80 of the charm 25 is formed from an elastic material and is smaller than the diameter 75 of the end 68 such that stretching of the mount portion 80 is needed to insert the charm 25 past the end 68 and onto the barrel 66. Many charms 25 can be held on the barrel 66 to aid in assembly to a pin 40 of the loom 28.

Referring to FIGS. 21A-21J with continued reference to FIGS. 19A and 20A, a method for assembling a charm 25 into a Brunnian linked item are schematically shown. The method includes assembling a first elastic band 14A across a first pin 40A and a second pin 40B as shown in FIG. 19A. A second elastic band 14B is held on the second pin 40B above the first elastic band 14A and stretched onto a third pin 40C. A third elastic band 14C is disposed on the third pin 40C over the second elastic band 14C and stretched onto yet another pin 40 not shown. As appreciated, multiple elastic bands would be provided across the loom 28 to form multiple links 12 to form a completed linked article 10.

Figure 21A:
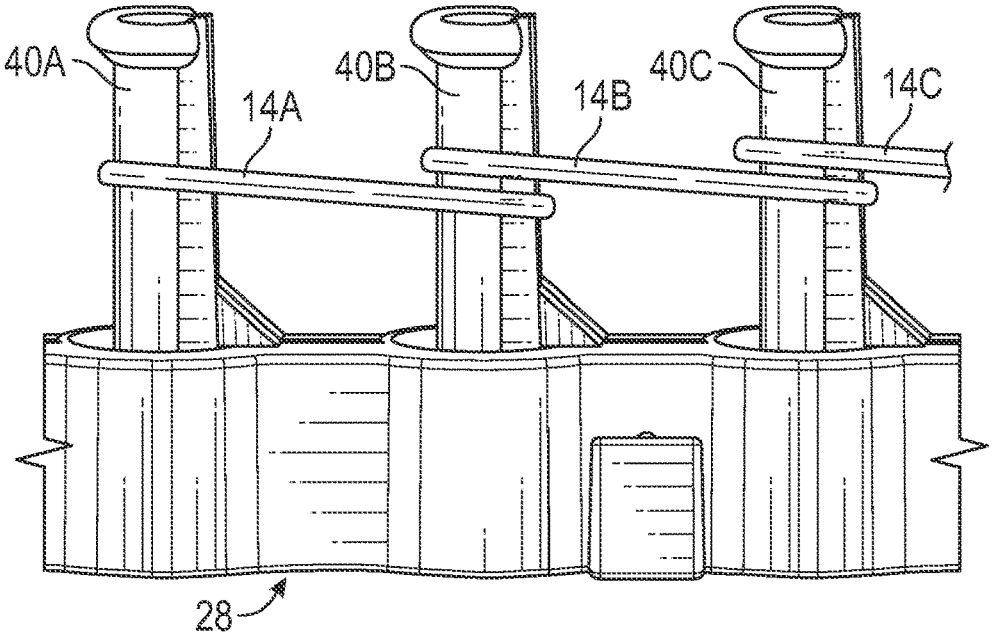
FIG. 21A is a schematic view of elastic bands supported on adjacent pins of a loom for forming a Brunnian link.
Figure 21B:
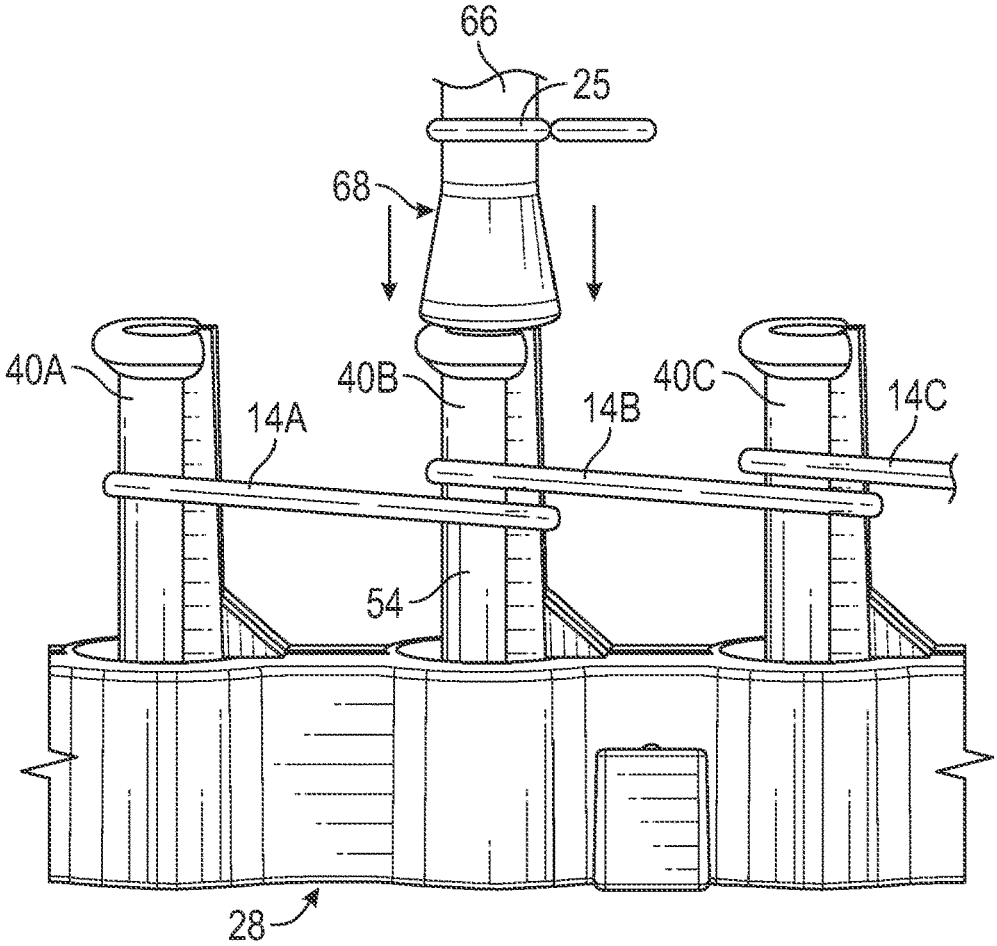
FIG. 21B is a schematic view of a charm being mounted to one of the pins for assembly in to a linked article.
Figure 21C:
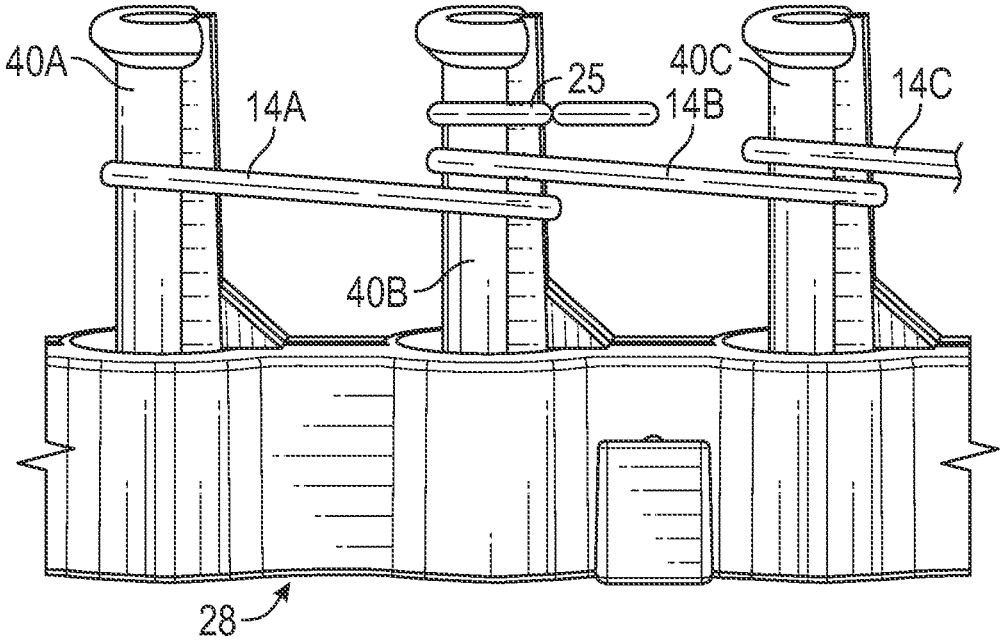
FIG. 21C is a schematic view of the charm mounted to one of the pins along with the elastic bands.

Referring to FIG. 21B, the end 68 with a charm 25 loaded on the barrel 66 is placed atop one of the pins 40. In this example, the end 68 is placed atop the second pin 40A in the same manner shown in FIG. 18. The charm 25 is slid from the barrel 66 onto the pin 40B to a position on the shaft 54. In this example, the charm 25 is disposed on the shaft 54 above both the first and second elastic bands 14A-B. Once the charm 25 is slide onto the pin 40B, the end 68 can be moved away to leave the elastic bands 14A-B and charm 25 in an orientation shown in FIG. 21C. Additional elastic bands 14 and charms 25 maybe assembled to the loom 28 as desired to create the linked article 10.

It should be appreciated that although the barrel 66 of the hook 24 may be used to install the charms 25 onto the pins 40, the charms 25 and/or elastic bands may be placed directly onto each pin 40 without utilizing the barrel 66.

Figure 21D:
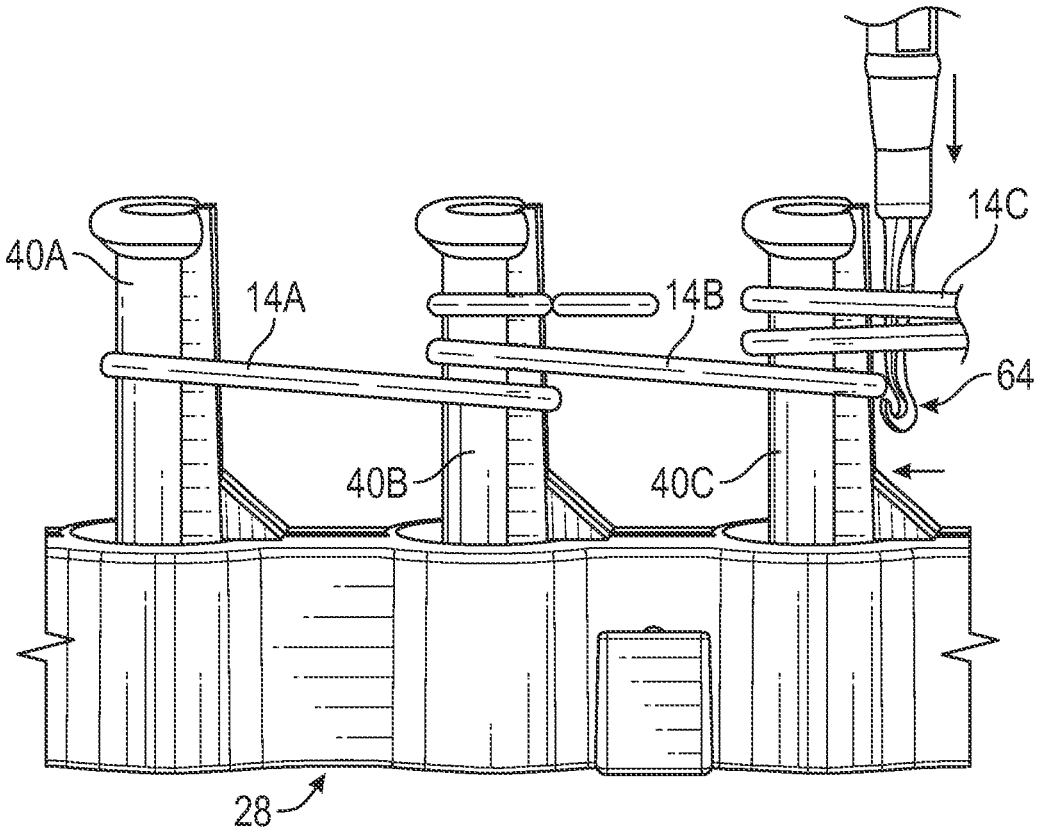
FIG. 21D is a schematic view of a step in forming a Brunnian link from elastic bands to include a charm.
Figure 21E:
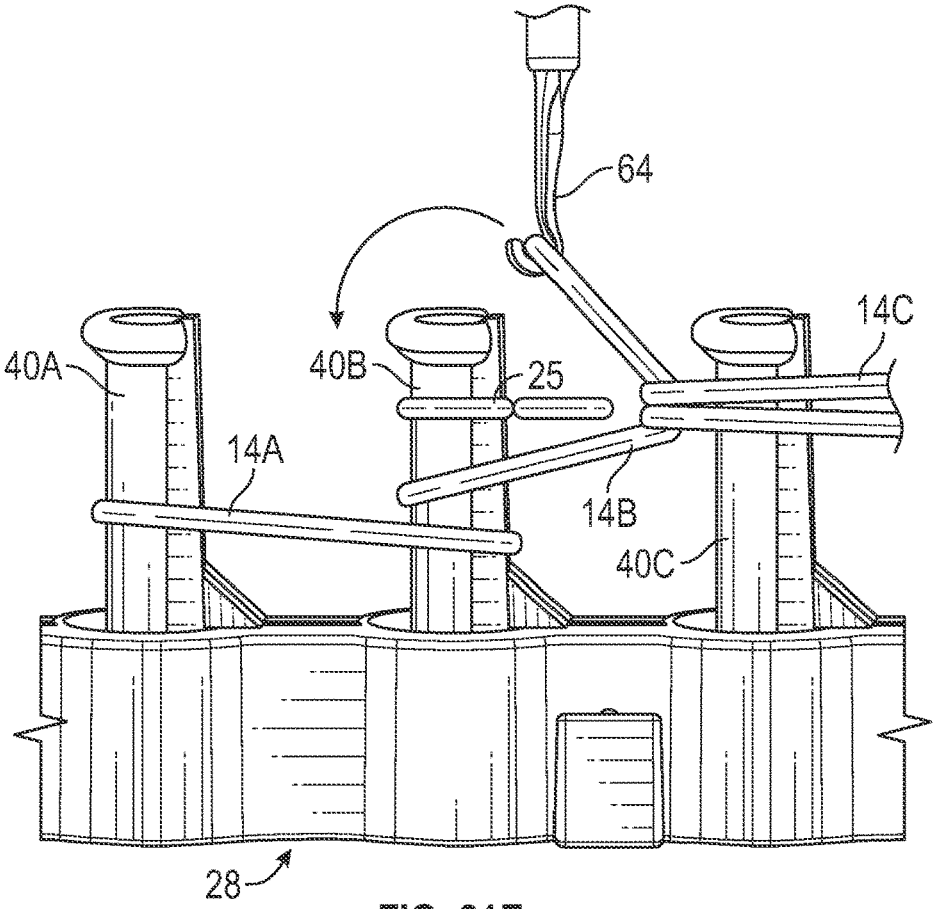
FIG. 21E is a schematic view of another step in forming a Brunnian link from elastic bands including a charm.

Referring to FIG. 21D, with the elastic bands 14A-C set on the pins 40A-C assembly and formation of the Brunnian links can begin. The hook 64 is used to pull the third elastic band 14C through another elastic band and back onto the third pin 40C. The hook 64 may be moved downward through the slot 60 from the top surface 58 to grasp the lower most elastic band 14 B. In this position, the third elastic band 14C has both ends on the third pin 40C above the second elastic band. A middle portion of the third elastic band 14C is engaged to another elastic band not shown in this Figure. The hook 64 grasps the second elastic band 14B, pulls the second elastic band upward through the third elastic band 14C and places onto the second pin 40B as is shown in FIG. 21E. A portion of the hook 64 extends into the slot 60 to aid in grasping the elastic band. The slot 60 in the pins 40 enable the hook tool 24 to extend down to the lowermost elastic band and pull the lower most elastic band back up and through the upper elastic bands and charms 25.

Figure 21F:
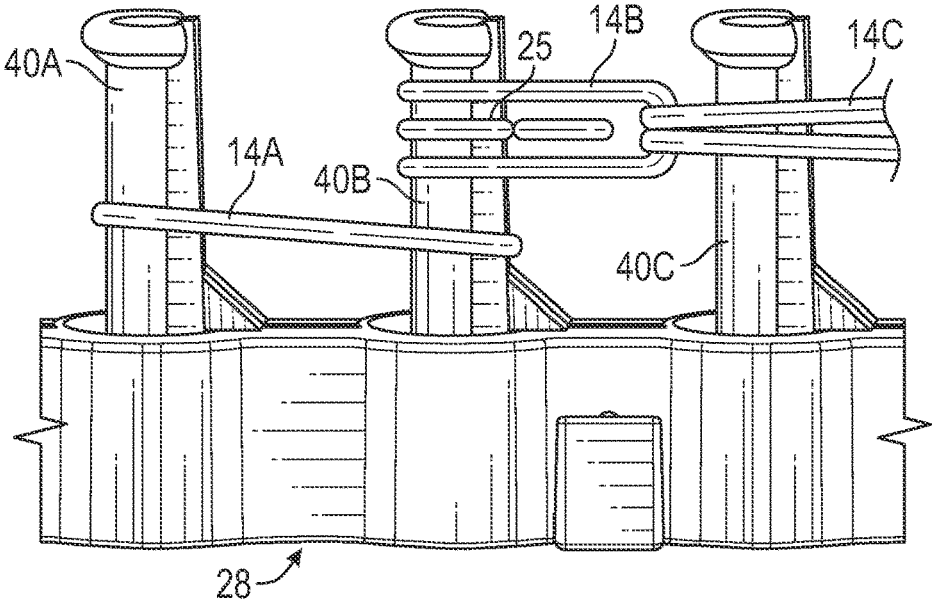
FIG. 21F is a schematic view of a further step in forming a Brunnian link from elastic bands including a charm.

Referring to FIG. 21F, the second elastic band 14C is therefore positioned such that each end is on the second pin 40B and its middle portion is held by the third elastic band 14C. The charm 25 is disposed between the ends of the second elastic band 14B.

Figure 21G:
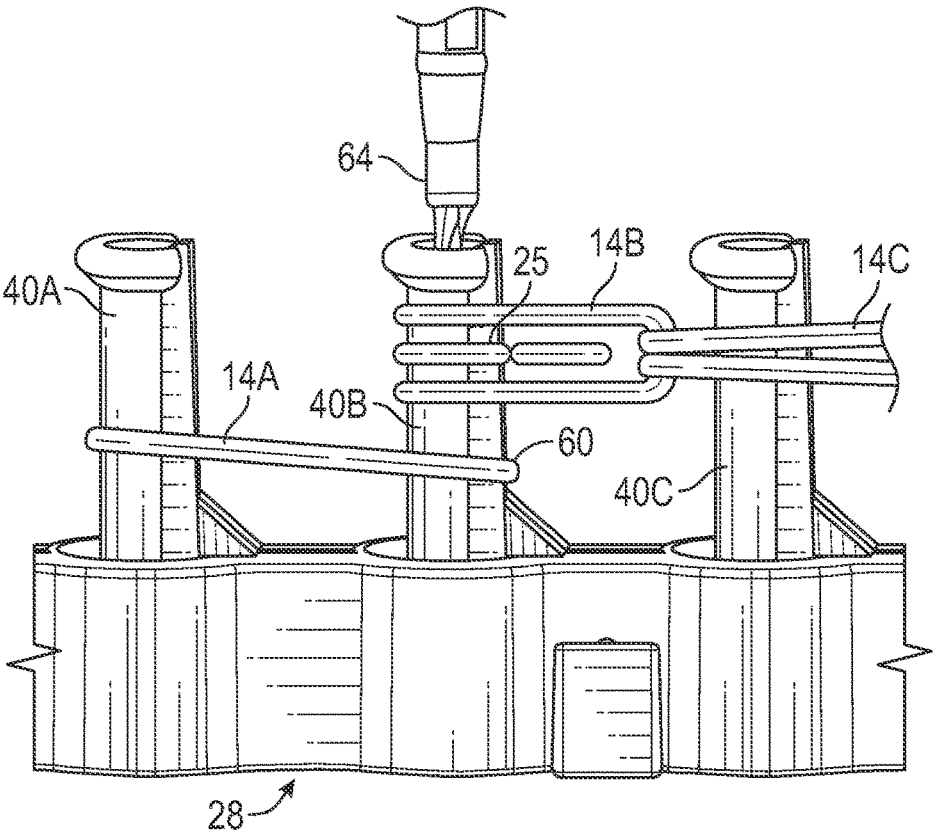
FIG. 21G is a schematic view illustrating a hook tool extending through an upper elastic band and the charm through a slot in a pin prior to grasping a lower band during formation of a Brunnian link.

Referring to FIG. 21G, the hook 64 is then moved to reach down through the each of the charm 25 and the second elastic band 14B to grasp the first elastic band 14A. The hook 64 in this disclosed embodiment extends through the slot 60 to aid in moving downward through the mount portion 80 of the charm 25 and inside the second elastic band 14B.

Figure 21H:
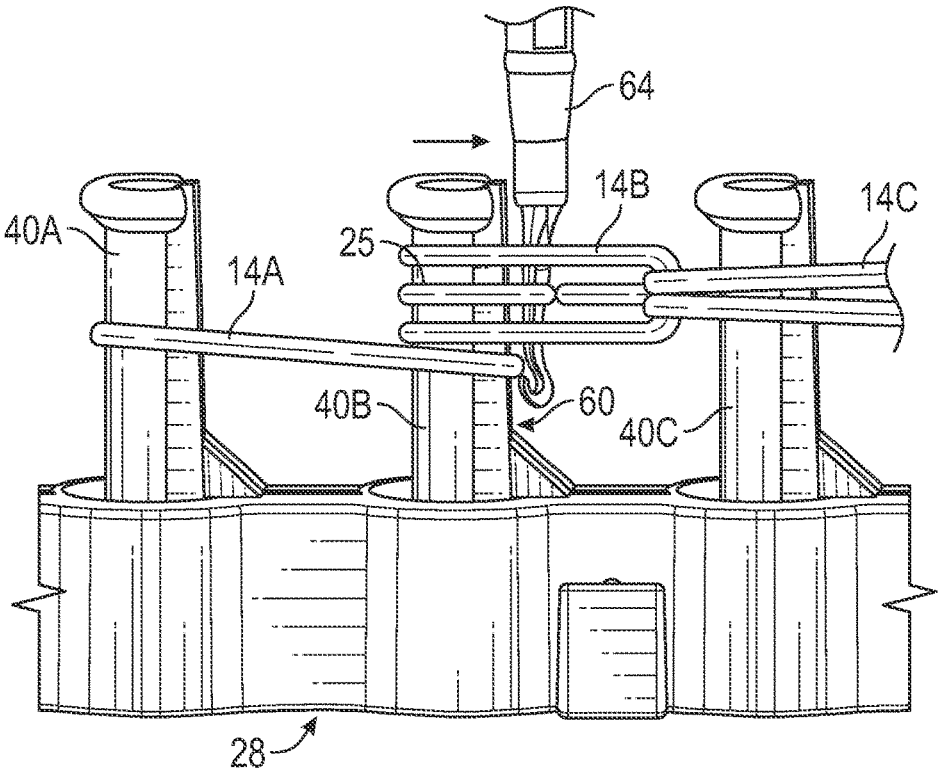
FIG. 21H is a schematic view of a hook tool moving outward from the slot in the pin to grasp a lower band.

Referring to FIG. 21H, the hook 64 is shown moved slightly out of the slot 60 and downward to grasp the first elastic band 14A.

Figure 21I:
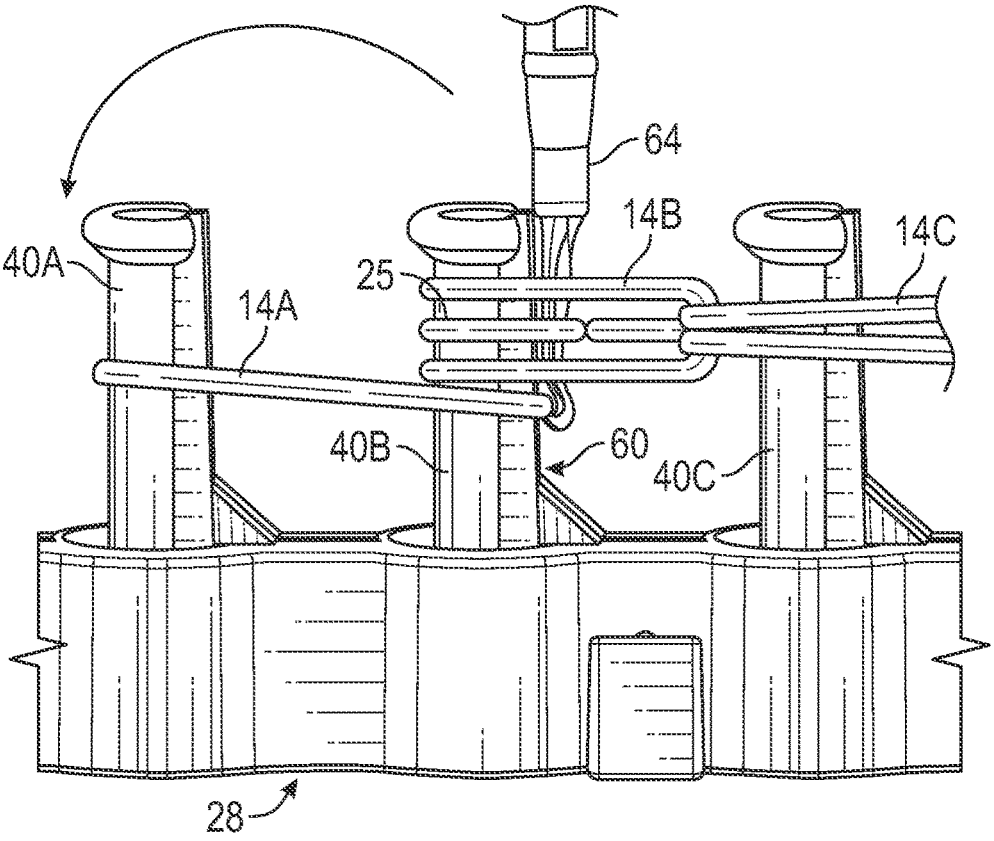
FIG. 21I is a schematic view of a hook tool grasping the lower elastic band and pulling the lower band upward through an upper elastic band and a charm.

Referring to FIG. 21I, the hook 64 is used to reach down through each of the charm 25 and the second elastic band 14B to grasp the first elastic band 14A. The hook 64 may be placed through the slot 60 to aid in moving downward through the mount portion 80 of the charm 25 and inside the second elastic band 14B. The first elastic band 14A is pulled upward through the each of the second elastic band 14B and the charm 25. The second elastic band 14B remains on the second pin 40B due to the flange 58 at the top of each pin. The slot 60 enables the hook 64 to extend through the upper elastic bands 14B and the charm 25 and also aids in grasping the lower most band that in this example is the first elastic band 14A.

Figure 21J:
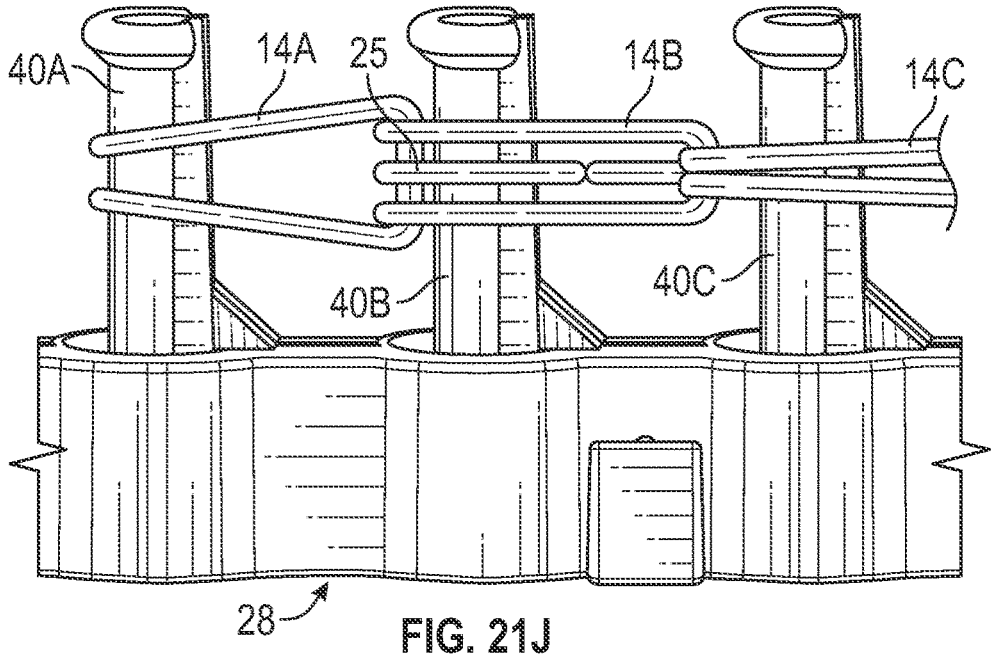
FIG. 21J is schematic view illustrating a Brunnian link including a charm.

Referring to FIG. 21J, the part of the elastic band 14A grasped by the hook 64 is placed onto the first pin 40A. The first elastic band 14A holds the charm 25 and a portion of the second elastic band 14B until the remainder of the links are formed.

This method utilizing the end 68 enables the charms 25 to be integrated into the Brunnian links formed by the elastic bands. It should be appreciated, that although mounting of the charm 25 is shown by way of example, other circular features could also be assembled into the Brunnian links with this method. For example, rings, other elastic bands as show in FIGS. 19A and 20A and/or other objects with an inner opening could be assembled to the Brunnian links formed on the example loom 28 with the disclosed method and are within the contemplation and scope of this disclosure.

Figure 22:
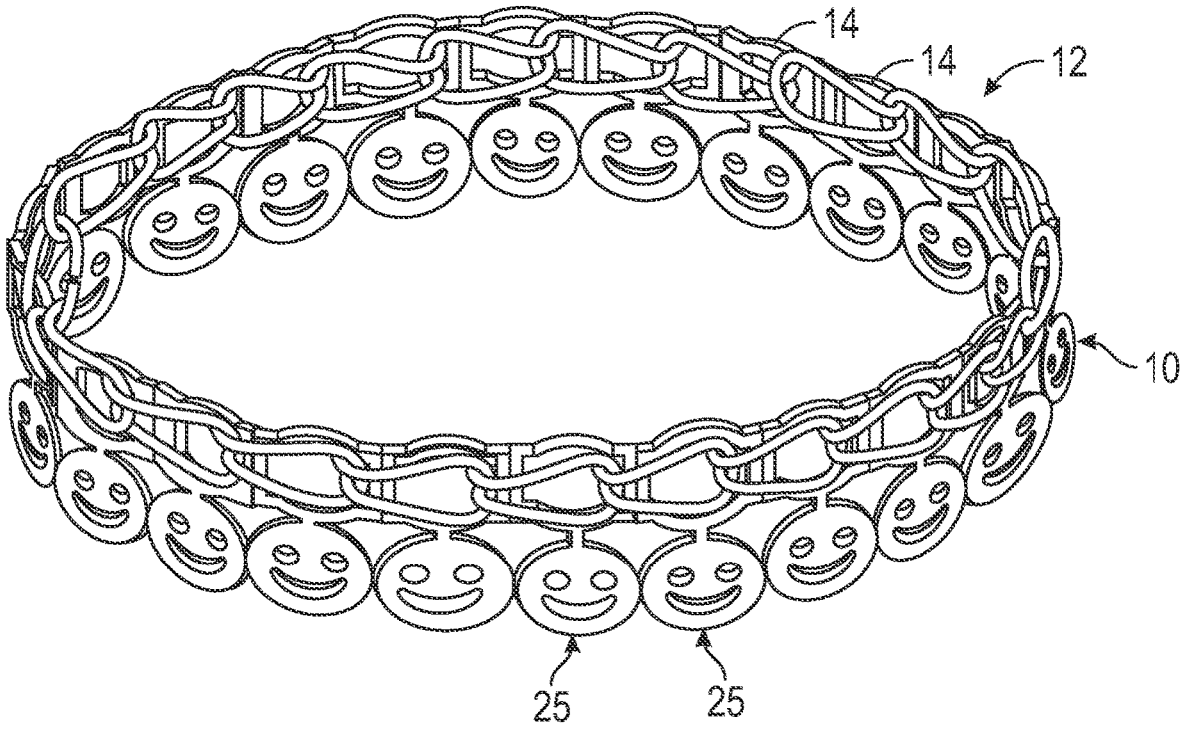
FIG. 22 is a perspective view of an example bracelet formed with elastic bands formed into Brunnian links with a plurality of charms.
Figure 23:
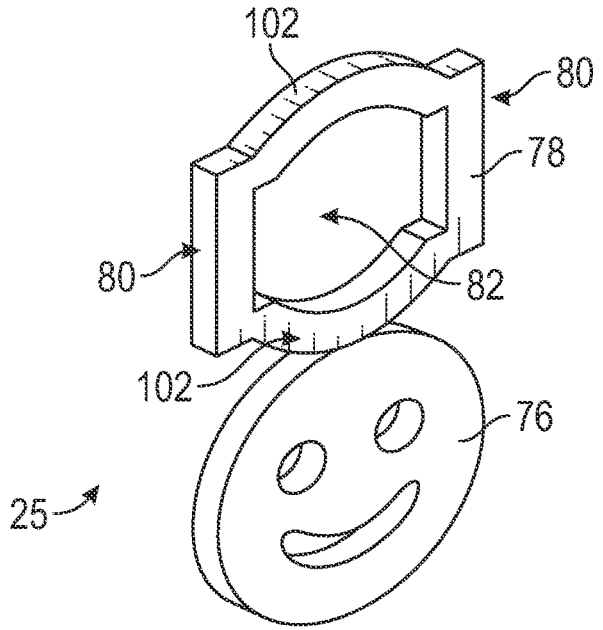
FIG. 23 is a perspective view of an example charm embodiment.
Figure 24:
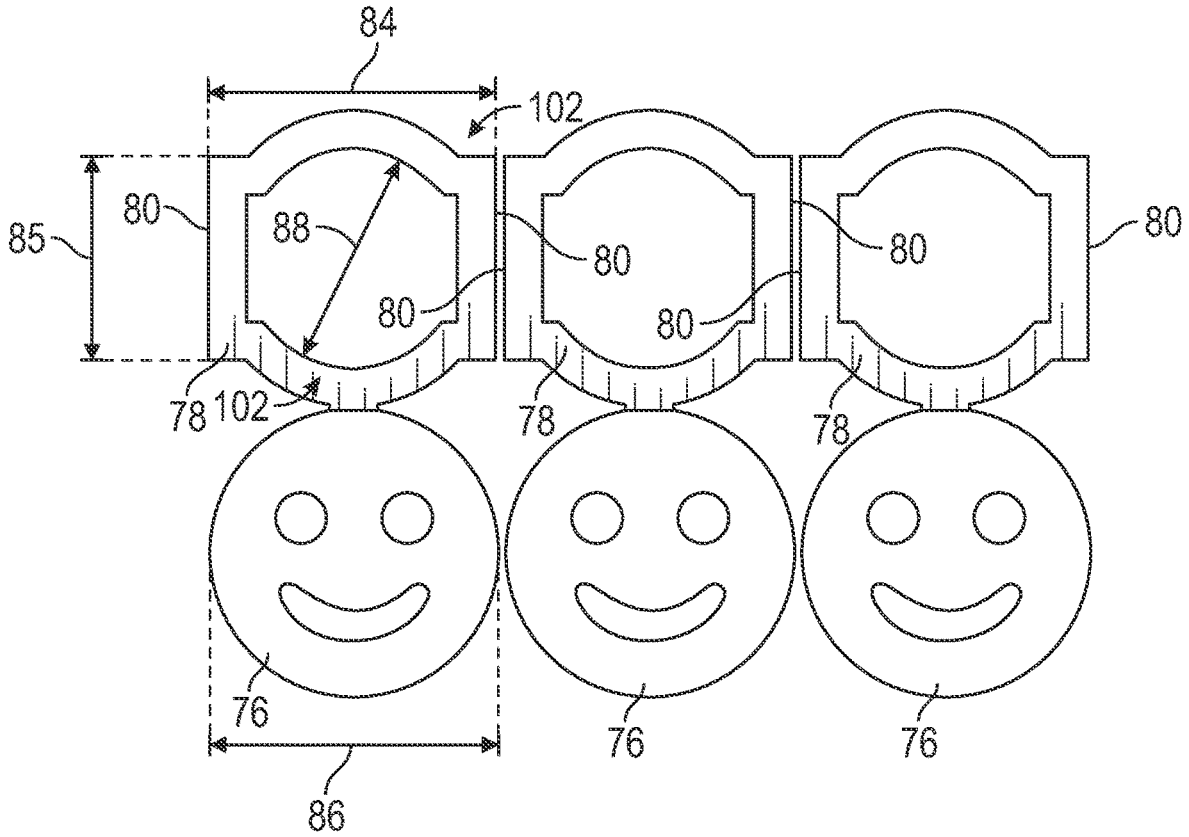
FIG. 24 is a front view of several charms orientated relative to each other.

Referring to FIGS. 22, 23 and 24, the charms 25 are shown integrated into each of the links 12 formed by the elastic bands 14 forming the completed linked article. The example charms 25 include the mount portion 78 with an inner open area 82 and a charm portion 76. The inner open area 82 includes a diameter 88 (FIG. 24) that corresponds with the width 75 of the pin shaft 79 and flange 77. Corresponding width 88 is used to describe a diameter that is similar such that the mount portion 78 is held in place on the individual pin 40 during assembly. The charm portion 76 includes a decorative symbol, character, letter, number, or any other decorative feature. In this example, the charm portion 76 is a smile face.

The example mount portion 78 includes sides 80 that are flat and parallel to each other. The flat sides 80 enable adjacent charms 25 to be orientated relative to each other in an aligned manner as is shown in FIG. 24. The flat sides 80 are parallel to each other and spaced a distance 84 apart. In this example, the charm portion 76 includes a width 86 that is smaller than the width 84 of the mount portion 78. The smaller width 76 of the charm portion 76 enables a spacing between the adjacent charm portions 76 while the mount portions 78 abut at the sides 80.

The example inner area 82 includes flat portions that substantially follow the outline of the mount portion 78. In this example, the mount portion 78 includes the flat sides 80 with a rounded top and bottom portions 102. A length 85 of each of the flat sides 80 are equal in this example. Moreover, the length 85 of the flat sides 80 could be longer or shorter than the entire mount portion. The length 85 is provided for the flat sides 80 to provide alignment with an adjacent charm 25 and may be different sizes that provide the alignment function.

Figure 25:
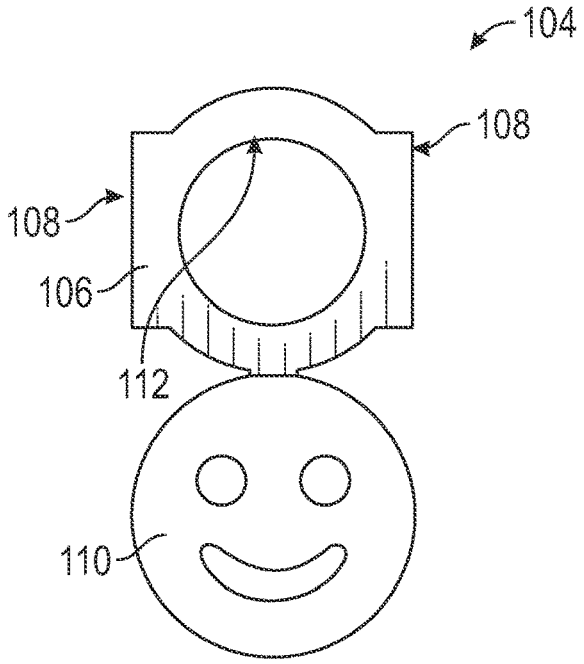
FIG. 25 is a front view of another charm embodiment.

Referring to FIG. 25, another charm 104 is shown that includes a mount portion 106 with flat side 108 and a charm portion 110. The inner area 110 is circular instead of conforming to the outer shape of the mount portion 106. It should be appreciated, that other configurations and shapes of the mount portion 106 and inner area 112 could be utilized and are within the contemplation and scope of this disclosure.

Figure 26:
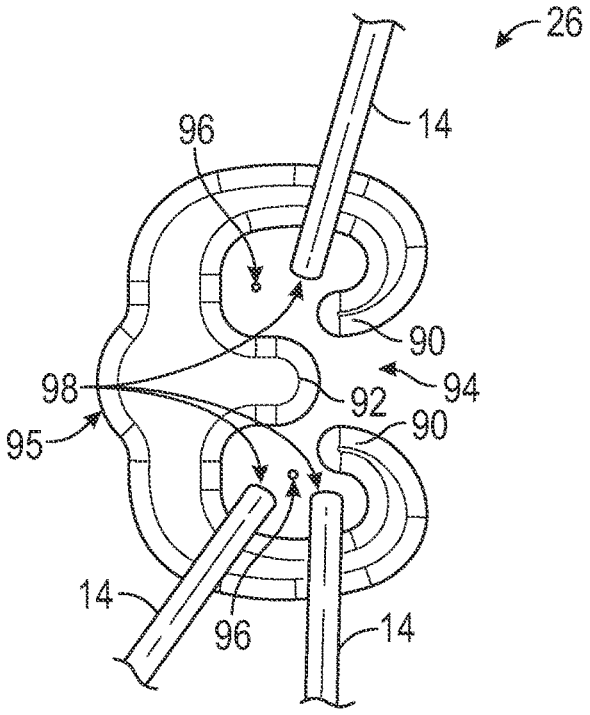
FIG. 26 is top view of an example clip embodiment.

Referring to FIG. 26, an example clip 26 for securing ends of a series of Brunnian links is shown. The clip 26 includes inner area 96 that is bounded by inward extending arm 90. The arm 90 is spaced apart from a tab 92 to define an opening into the inner area 96. Ends 98 of elastic bands 14 are deterred from slipping out of the inner area 96 by the inward extending arms 90. The clip 26 includes an outward extending bump 95 on a back side that provides alignment relative to abutting ends of the series of links.

Accordingly, the example kit and method provide for the creation of many different combinations and configurations of Brunnian links for the creation of bracelets, necklaces, and other linked items. Moreover, the example kit is expandable to further create and expand the capabilities of potential Brunnian link creations. The example kit provides for the creation of such links and items in an easy manner allowing persons of varying skill levels to be successful in creating unique wearable items.

Although an example embodiment has been disclosed, a worker of ordinary skill in this art would recognize that certain modifications would come within the scope of this disclosure. Moreover, no part of disclosure is intended, either explicitly or implicitly, as any disclaimer or narrowing of claim scope. The description of any one embodiment is not intended, either explicitly or implicitly, as limiting the plain and ordinary meaning set out in the following claims. The example embodiment is only one of many possible structures and methods that are properly within the scope of this disclosure. For that reason, the following claims should be studied to determine the scope and content of this disclosure.

What is claimed is:

1. A loom comprising:

a top surface;

a plurality of pins extending outward from the top surface, the plurality of pins arranged in at least three longitudinally extending rows including a middle row, a first side row and a second side row, each of the plurality of pins including a flange near a top end and a slot through the flange and the top end; and a plurality of distinct openings through the top surface, each of the plurality of distinct openings bounded by a corresponding distinct set of four of the plurality of pins, wherein each of the corresponding distinct set of four of the plurality of pins includes two pins disposed in the middle row, one pin disposed in the first side row and another pin disposed in the second side row.

2. The loom as recited in claim 1, wherein each of the plurality of pins includes a shaft portion and the shaft portion of one of the four of the plurality of pins defines a portion of a side of the opening.

3. The loom as recited in claim 1, including a bottom surface with the opening extending from the top surface through the bottom surface.

4. The loom as recited in claim 1, including an attachment feature for attaching a second loom, the attachment feature disposed on at least one side of the loom.

5. The loom as recited in claim 4, wherein the attachment feature includes a tab on one loom that fits within a slot on the second loom.

6. The loom as recited in claim 1, including a channel disposed within the top surface and open to the slot of a corresponding one of the plurality of pins.

7. The loom as recited in claim 1, wherein pins within the middle row are offset relative to pins in each of the first side row and the second side row.

* * * * *